US006418695B1

(12) United States Patent
Daudet et al.

(10) Patent No.: US 6,418,695 B1
(45) Date of Patent: Jul. 16, 2002

(54) BUILDING COMPONENT SPACER BRACE

(75) Inventors: Larry R. Daudet, Porter, IN (US); Edmund L. Ponko, Pittsburgh, PA (US); Gregory S. Ralph, Valparaiso, IN (US)

(73) Assignee: Aegis Metal Framing LLC, Chesterfield, MO (US)

( * ) Notice: Subject to any disclaimer, the term of this patent is extended or adjusted under 35 U.S.C. 154(b) by 0 days.

(21) Appl. No.: 09/573,574

(22) Filed: May 18, 2000

(51) Int. Cl.[7] ..... E04C 5/16

(52) U.S. Cl. ..... 52/677; 52/639; 52/696; 52/712

(58) Field of Search ..... 52/677, 639, 696, 52/712, 127.2, 650.2, 695

(56) References Cited

U.S. PATENT DOCUMENTS

| | | | | |
|---|---|---|---|---|
| 894,711 | A | 7/1908 | Worcester | 20/4 |
| 947,514 | A | 1/1910 | Stevens | 52/695 |
| 1,656,741 | A | 1/1928 | Lane | 52/695 |
| 1,685,729 | A | 9/1928 | Stone | 52/695 |
| 2,282,624 | A | 5/1942 | Upson et al. | 72/118 |
| 2,686,959 | A | 8/1954 | Robinson | 33/613 |
| 2,856,646 | A | 10/1958 | Latimer | 20/4 |
| 2,963,127 | A | 12/1960 | Manville | 52/693 |
| 2,964,807 | A | 12/1960 | Kennedy | 20/9 |
| 2,966,708 | A | 1/1961 | Freeman, Jr. | 52/696 |
| 3,010,162 | A | 11/1961 | Klein | 52/696 |
| 3,201,874 | A | 8/1965 | Christy | 33/180 |
| 3,668,828 | A | 6/1972 | Nicholas et al. | 52/92 |
| 3,875,719 | A | 4/1975 | Menge | 52/669 |
| 3,908,328 | A | 9/1975 | Nelsson | 52/735 |
| 4,075,810 | A | 2/1978 | Zakrzewski et al. | 52/585 |
| 4,080,771 | A | 3/1978 | Weller | 52/735 |
| 4,227,360 | A | 10/1980 | Balinski | 52/720 |
| 4,229,915 | A | 10/1980 | Snow et al. | 52/92 |
| 4,246,736 | A | 1/1981 | Kovar et al. | 52/696 |
| 4,426,822 | A | 1/1984 | Gailey | 52/669 |
| 4,490,956 | A | 1/1985 | Palacio et al. | 52/639 |

(List continued on next page.)

FOREIGN PATENT DOCUMENTS

| | | | |
|---|---|---|---|
| AU | 23961/77 | 10/1978 | |
| CA | 2077170 | 3/1994 | |
| EP | 0080088 | 6/1983 | 52/696 |
| EP | 0373727 | 6/1990 | 52/696 |
| EP | 0637656 | 2/1995 | 52/696 |
| GB | 1566160 | 4/1980 | 52/696 |
| GB | 2103264 A | 2/1983 | 52/696 |
| GB | 2272715 | 5/1994 | 52/696 |
| JP | 9-4067 | 1/1997 | |

OTHER PUBLICATIONS

E.N. Lorre, Residential Steel Framing Construction Guide, 1993, Laguna Hills, CA, 17 C.3, C.2B, C.4, C.5, C.6, C.7, C.8, C.9, C.17, C,18, C.25, C.26, D.9, D.10, D.11, D.12, D.13A, D.13B, D.14, D.15, D.21A, D.20, D.21B, D.22, D.23, E.11, E.12, E.13, E.14,E.15, E.16, E.19, F.1, F.2, F.3, F.4, F.5, F.6, F.7, F.8, F.14, F.15, F.16, F.19, F.20.

Truswall Systems, Don't Just Space it, Brace It Brochure, Arlington, TX, Publication Date, unknown.

Dietrich Industries, Inc., 1st Step To Residential Metal Framing (Non–Load Bearing Walls), 6/94, Pittsburgh, PA.

Angles Metal Systems, Technical Data Sheets 107 and 108, 1984, Los Angeles, CA.

Metal Lite Inc. Brochure, 7/1991, Anaheim, California.

*Primary Examiner*—Beth A. Stephan
*Assistant Examiner*—Naoko Slack
(74) *Attorney, Agent, or Firm*—Kirkpatrick & Lockhart LLP

(57) ABSTRACT

A spacer bar for use in connection with support building components at predetermined intervals relative to each other. The spacer bar may be used in connection with building components fabricated from wood, metal, etc. and includes at least two pair of clamping tabs for engaging and retaining the components in the desired position.

57 Claims, 34 Drawing Sheets

U.S. PATENT DOCUMENTS

| | | | | |
|---|---|---|---|---|
| 4,538,391 | A | 9/1985 | Skrabis et al. | 52/478 |
| 4,637,195 | A | 1/1987 | Davis | 52/693 |
| 4,688,358 | A | 8/1987 | Madray | 52/90 |
| 4,704,829 | A | 11/1987 | Baumker, Jr. | 52/127.2 |
| 4,843,726 | A | 7/1989 | Ward | 33/613 |
| 4,986,052 | A | 1/1991 | Nelson | 52/745 |
| 5,161,345 | A | 11/1992 | Sobjack, Sr. | 52/652 |
| 5,274,973 | A | 1/1994 | Liang | 52/243 |
| 5,313,752 | A | 5/1994 | Hatzinikolas | 52/243 |
| 5,353,560 | A | 10/1994 | Heydon | 52/281 |
| 5,551,200 | A | 9/1996 | Krug | 52/696 |
| D374,292 | S | 10/1996 | Koo et al. | D25/61 |
| 5,606,837 | A | 3/1997 | Holizlander | 52/693 |
| 5,822,942 | A | 10/1998 | Lucia, Jr. | 52/514 |
| 5,870,874 | A | 2/1999 | Brothers | 52/696 |
| 5,899,042 | A | 5/1999 | Pellock | 52/696 |
| 6,021,618 | A | 2/2000 | Elderson | 52/667 |

BUILDING COMPONENT SPACER BRACE

CROSS-REFERENCE TO RELATED APPLICATIONS

Not applicable.

FEDERALLY SPONSORED RESEARCH

Not applicable.

BACKGROUND OF THE INVENTION

1. Field of the Invention

The subject invention relates to devices for installing and supporting building components and, more particularly, to a spacer and support apparatus for supporting roof and floor trusses.

2. Description of the Invention Background

A truss is a rigid framework of wooden or metal beams designed to support a structure, such as a roof. Trusses may also be employed to span between opposing support walls to create a floor supporting structure within a building. A truss system for supporting a floor may comprise a collection of trusses that are arranged adjacent to each other and span the distance between two or more support walls. Local building codes and structural design requirements generally govern the amount of spacing permitted between each truss. When anchored to the support walls, the tops of the trusses are substantially co-planar with each other to enable floor or roof decking materials to be attached thereto.

Roof trusses may be provided in a variety of different shapes and sizes depending upon the building design. Although some roof truss systems provide a plurality of planar, horizontally disposed, support surfaces for buildings with flat roof systems, many buildings have roofs that have planar portions that are not horizontally disposed. For example, many residential buildings have peaked roofs wherein the roof surface comprises a pair of angled planes that intersect to form the roof crown or peak. Flat sheathing material is attached to the trusses to form a planar roof surface and roofing material is then affixed to the sheathing. Trusses may be fabricated on site from appropriate material such as wood, metal, etc. However, it is common practice for trusses to be fabricated off-site by an entity that specializes in the fabrication of such building components. The prefabricated trusses are then shipped to the building site and anchored in place to the support structures. Such support structures may comprise concrete block walls, stud walls, etc.

A truss typically includes a bottom member commonly referred to as the "bottom chord". The bottom chord is the member that is supported on and anchored to the top of the support walls. Trusses typically also include two or more top chords that are attached to the bottom chord. In a typical "peak roof" truss, two top chord members are each attached to one end of the bottom chord and angle upward at a desired pitch. The other ends of each top chord are connected together to form the roof peak. A portion of each top chord may extend beyond the bottom chord to form a desired amount of overhangs that extend beyond the support walls. Similarly, in other truss arrangements, the bottom chord may extend beyond the support walls in a cantilevered fashion. A variety of braces or web members extend between the top chords and the bottom chord to provide the roof with a desired load capacity.

Trusses are commonly installed by standing the bottom chords of the trusses on edge on the support structures (walls) such that they span between the parallel walls. The ends of the bottom chords are then anchored to the support walls by screws, nails, or other appropriate anchors. A plurality of trusses are arranged in a side-to side configuration along the tops of the support walls. In some truss arrangements, the truss has a greater height dimension than a width dimension. Thus, prior to attaching the sheathing materials, a truss that is supported only at its bottom by its attachment to supporting walls can be prone to topple over on its side. Such toppling over of even one truss can result in all of the trusses falling over similar to a row of dominos which can cause injury to construction personnel and damage the trusses and other building components.

A variety of bracing devices have been constructed for supporting trusses during installation. For example, U.S. Pat. No. 3,875,719 to Menge, U.S. Pat. No. 4,080,771 to Weller, U.S. Pat. No. 4,490,956 to Placio et al., U.S. Pat. No. 4,704,829 to Baumaker, Jr., U.S. Pat. No. 5,161,345 to Sobjack, Sr., U.S. Pat. No. 5,551,200 to Krug and U.S. Pat. No. 5,606,837 to Holizlander all disclose devices which purport to solve such problems. However, many of such devices require that the bracing element be fastened to the respective truss member by a separate fastener before any lateral supporting of the truss is achieved. Still others, while providing a modicum of lateral support to the trusses prior to affixing the brace devices to the trusses with mechanical fasteners (screws, nails, etc.), are difficult to manufacture. Other such devices fail to provide adequate support between adjacent truss members and are not suited for attachment to a variety of different truss materials. Still some other devices employ teeth that must be hammered into the truss and, if not installed properly, can lead to splintering and truss damage. Furthermore, such toothed devices will not work with steel trusses and other building components fabricated from steel. Yet other devices, while effective for supporting trusses during their installation, must be removed before roofing sheathing or floor decking can be installed.

Thus, there is a need for a spacer bar for trusses and the like that is relatively easy to manufacture and install.

There is a further need for a spacer bar that will rigidly support trusses in position during installation of additional fasteners.

Yet another need exists for a spacer bar with the above-mentioned characteristics that does not have to be removed prior to installing roof or floor decking materials.

Still another need exists for a spacer bar that can be used to support a variety of different structural components regardless of the type of material from which they are constructed.

SUMMARY OF THE INVENTION

In accordance with one form of the present invention, there is provided a spacer bar that comprises an elongated planar brace member that has a planar upper surface, a planar lower surface, a first end and a second end. A first tab that has a first flared lower portion perpendicularly protrudes from the planar lower surface of the elongated planar brace member. A second tab perpendicularly protrudes from the lower surface of the elongated planar brace member and is spaced from the first tab a first predetermined distance. A third tab perpendicularly protrudes from the lower surface of the elongated planar brace member and is spaced from the second tab a second predetermined distance. A fourth tab perpendicularly protrudes from the lower surface of the elongated planar brace member and is spaced from the third tab a third predetermined distance. At least one of the third and fourth tabs has a flared lower portion. In one embodiment, a first lateral side member protrudes perpendicularly downward from a first lateral portion of the brace member and extends between the second tab and the third tab. Also in this embodiment, a second lateral side member protrudes perpendicularly downward from a second lateral side portion of said planar brace member and extends between the second tab and the third tab. A third lateral side member protrudes perpendicularly downward from a third lateral side portion and extends from the first end to the first tab. A fourth lateral side member protrudes perpendicularly downward from a fifth lateral side portion and extends from the first end to the first tab. A fifth lateral side member protrudes perpendicularly downward from a fifth lateral side portion and extends from the second end to the fourth tab. A sixth lateral side member protrudes perpendicularly downward from a sixth lateral side portion and extends from the second end to the fourth tab.

The subject invention may also include fifth and sixth tabs that perpendicularly protrude from the lower surface of the planar brace member. In one embodiment, the second tab is spaced from the first tab such that the distance therebetween is equal to or slightly greater than the cross-sectional thickness of a first structural member to be inserted therebetween. Similarly, the fourth tab is spaced from the third tab such that the distance therebetween is slightly greater than or equal to the cross-sectional thickness of a second structural member to be inserted therebetween. Likewise, the sixth tab is spaced from the fifth tab such that the distance therebetween is slightly greater than or equal to the cross-sectional thickness of a third structural member to be inserted therebetween. Reinforcing members may be provided between the second and third tabs and the fourth and fifth tabs to provide the spacer bar with additional rigidity and downwardly protruding lateral side members may extend between the second and third tabs and the fourth and fifth tabs. In addition, lateral side tabs may extend from a first end of the brace member to the first tab and additional tabs may extend from the second end of the brace member to the sixth tab.

Another embodiment of the present invention comprises a spacer bar that includes an elongated planar brace member that has a planar upper surface and a planar lower surface. A first portion is punched from the elongated planar brace member and is bent substantially perpendicular to the lower planar surface to form a first tab. A second portion is punched from the elongated planar brace member and is bent substantially perpendicular to the lower planar surface to form a second tab spaced from the first tab such that a first planar portion of the planar brace member extends therebetween. A third portion is punched from the elongated planar brace member and is bent substantially perpendicular to the lower planar surface to form a third tab that is spaced from the second tab. A fourth portion is punched from the elongated planar brace member and is bent substantially perpendicular to the lower planar surface to form a fourth tab that is spaced from the third tab to define a second planar portion of the elongated brace member therebetween.

The subject invention also comprises a method for bracing a first truss relative to a second truss in a desired spaced-apart relationship on a support member. The method includes providing a planar brace member that has a first pair of integral clamping tabs protruding therefrom. The first pair of integral clamping tabs are spaced from each other a first distance that is greater than by a predetermined magnitude or is equal to a cross-sectional thickness of the first truss. The brace member also has a second pair of integral clamping tabs protruding therefrom. The second clamping tabs are spaced from each other a second distance that is greater than by a predetermined magnitude or is equal to a cross-sectional thickness of the second truss. The method further includes placing the first truss on edge on the support member and placing the second truss on edge on the support member a predetermined distance from the first truss. The first clamping tabs are forced into clamping engagement with the first truss member and the second clamping tabs are forced into clamping engagement with the second truss.

It is a feature of the present invention to provide a spacer bar for structural building components such as trusses and the like that is easy to manufacture and install.

It is another feature of the present invention to provide a spacer bar that will rigidly support trusses in position during installation of fasteners such as nails, screws and the like to further affix the spacer bar to the trusses.

Yet another feature of the present invention is to provide a spacer bar with the above-mentioned characteristics that does not have to be removed prior to installing roof or floor decking materials.

Still another feature of the present invention is to provide a spacer bar that can be used to support a variety of different structural components regardless of the type of material from which they are constructed.

Yet another feature of the present invention is to provide a means for supporting trusses or other building components on edge prior to fastening such components together. Thus, the present invention results in improved safety, because the installer is able to obtain the requisite tools and fasteners without having to simultaneously support the truss or building component in a desired orientation.

Accordingly, the present invention provides solutions to the shortcomings of prior truss spacer devices and braces. The subject invention is easy to manufacture and install. The subject invention may be installed on a plurality of trusses without risk of the trusses toppling as additional fasteners are installed. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
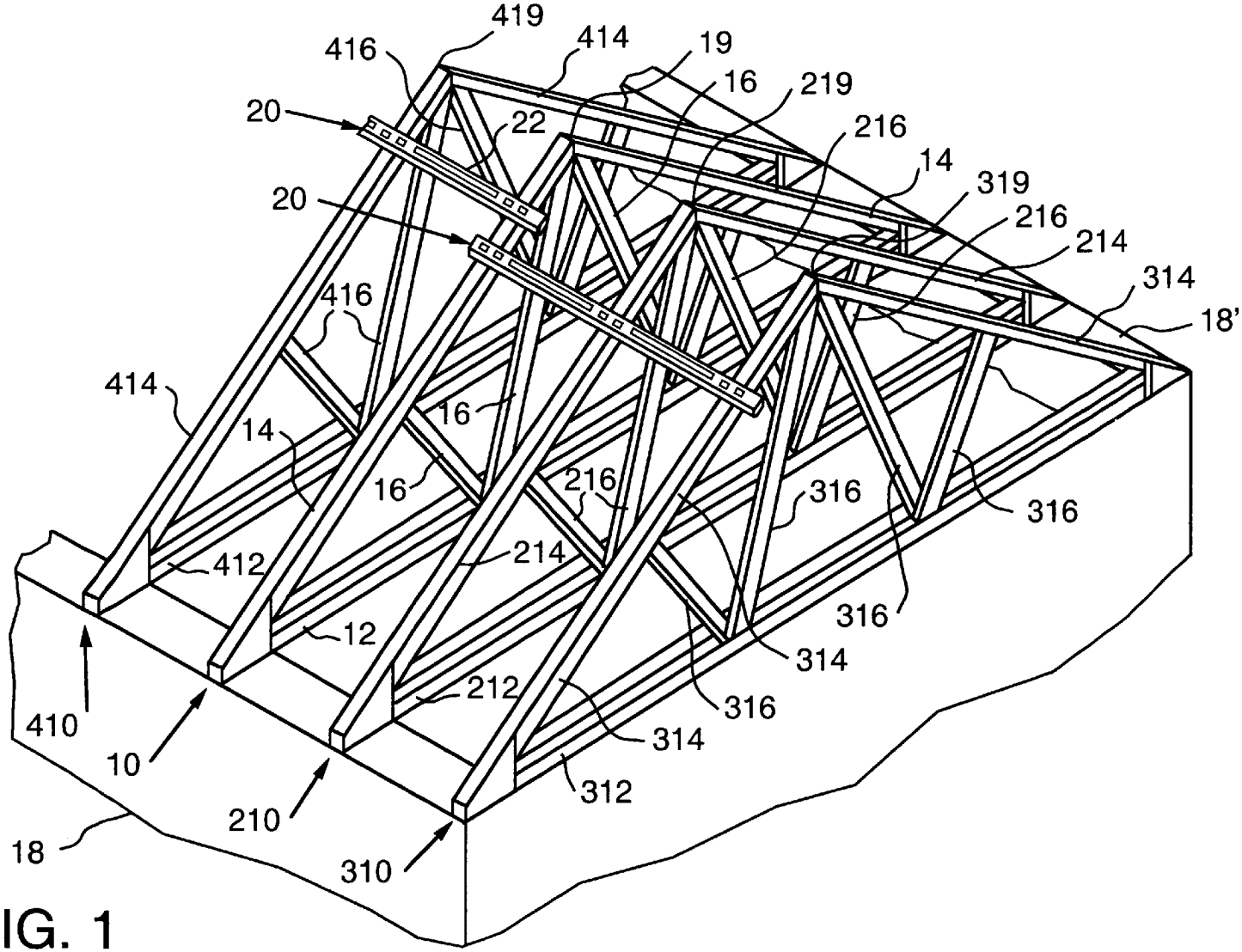
FIG. 1 is a perspective view of two spacer bars of the present invention supporting a plurality of roof trusses on support walls.
Figure 2:
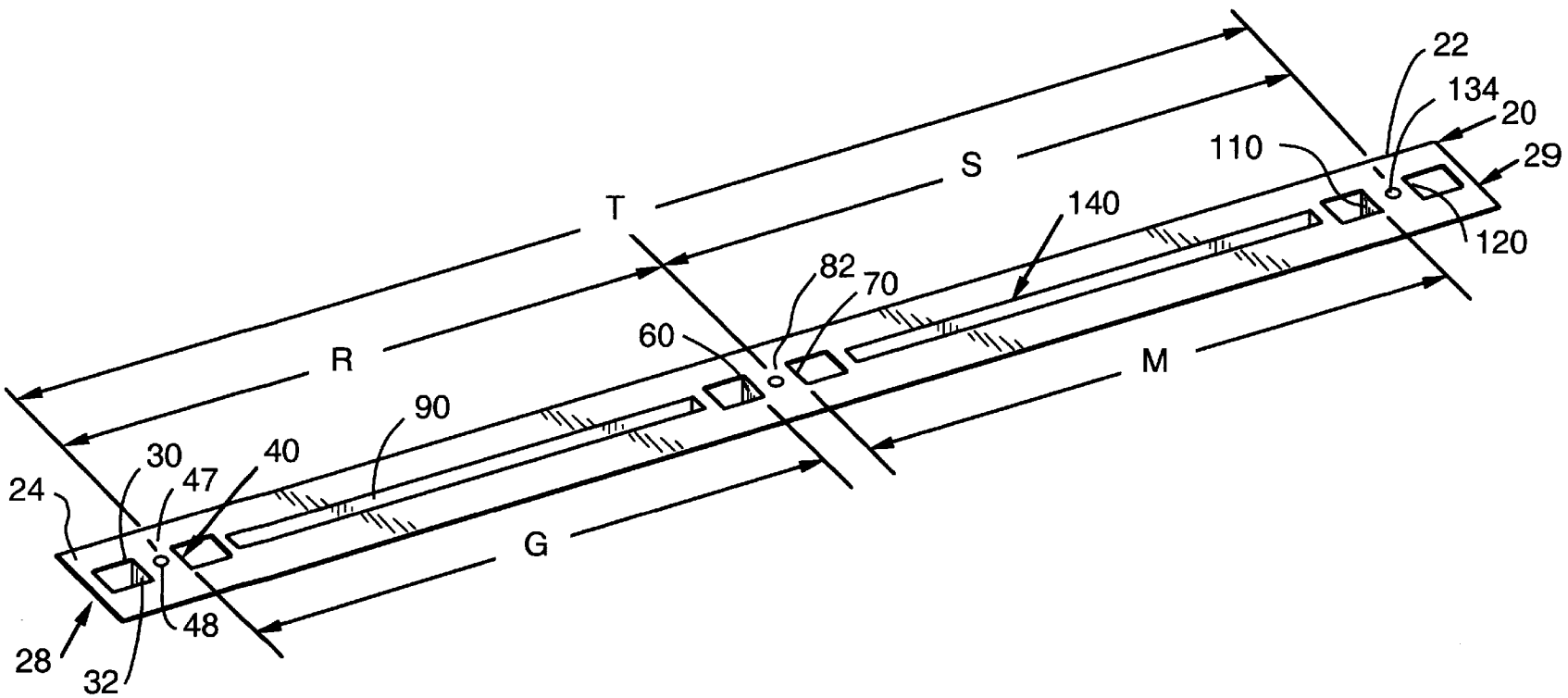
FIG. 2 is a perspective view of a spacer bar of the present invention.
Figure 3:
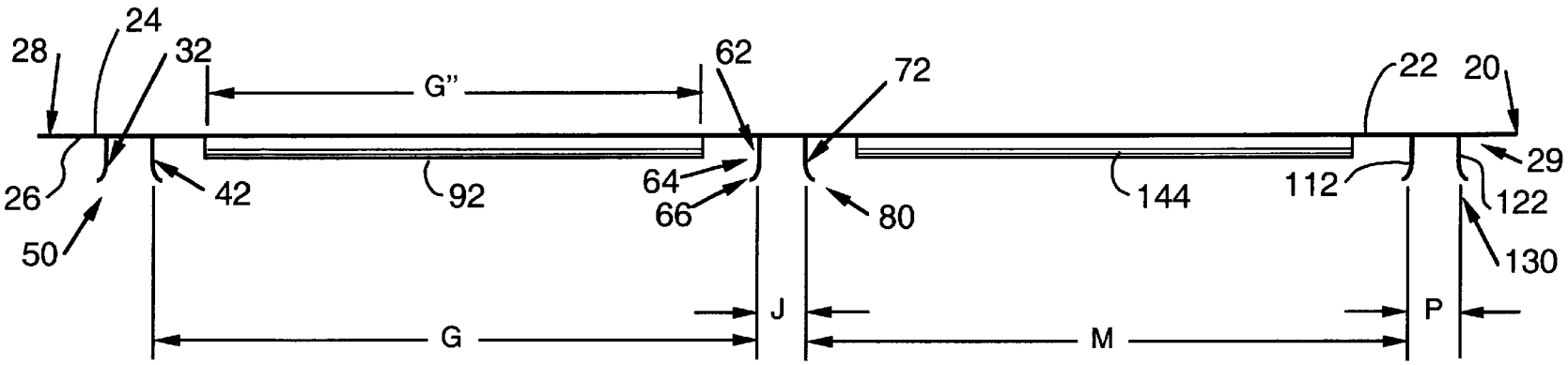
FIG. 3 is a front elevational view of the spacer bar of FIG. 2.
Figure 4:
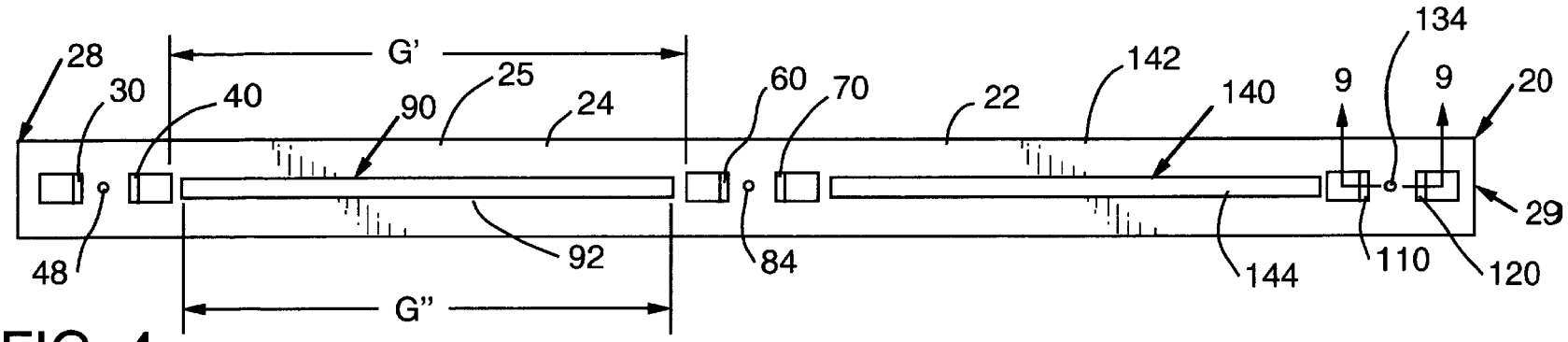
FIG. 4 is a top view of the spacer bar of FIGS. 2 and 3.
Figure 5:
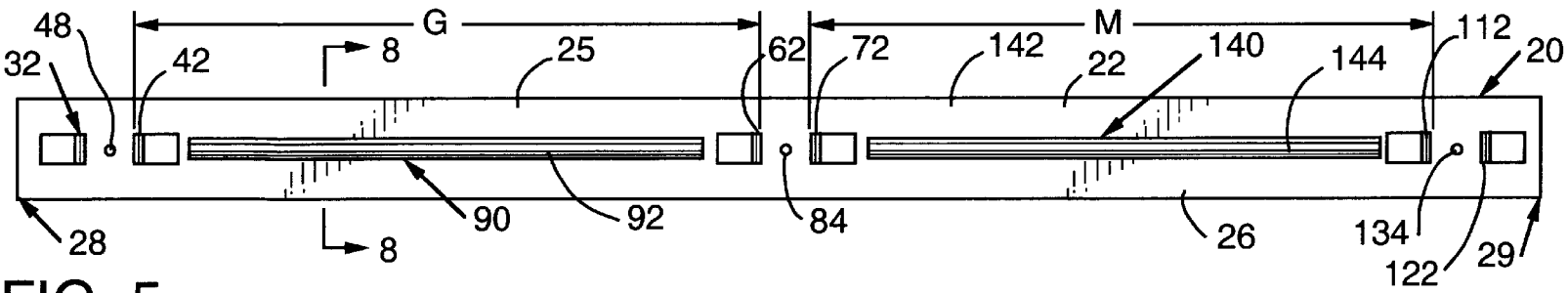
FIG. 5 is a bottom view of the spacer bar of FIGS. 2–4.
Figure 9:
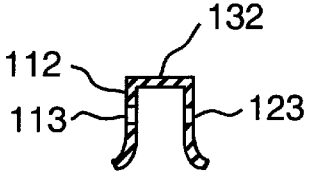
FIG. 9 is a partial cross-sectional view of the spacer bar of FIGS. 2–8 taken along line 9—9 in FIG. 4.
Figure 8:
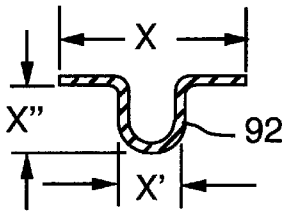
FIG. 8 is a cross-sectional view of the spacer bar of FIGS. 2–7 taken along line 8—8 in FIG. 5.
Figure 7:
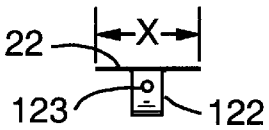
FIG. 7 is a right end elevational view of the spacer bar of FIGS. 2–6.
Figure 6:
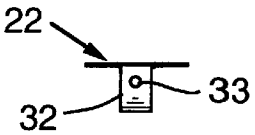
FIG. 6 is a left end elevational view of the spacer bar of FIGS. 2–5.

Referring now to the drawings for the purposes of illustrating the present embodiments of the invention only and not for the purposes of limiting the same, there is shown a spacer bar 20 of the present invention for use in connection with structural building components such as roof trusses, floor trusses, etc. FIG. 1 depicts two spacer bars of the present invention used in connection with a plurality of conventional roof trusses (10, 210, 310, 410). The reader will appreciate that truss 10 may comprise a bottom chord 12 and a pair of upper chords 14 that are attached at one of their respective ends to the bottom chord 12 at a desired pitch. The other ends of the upper chords 14 are attached together to form the peak 19. A plurality of appropriate web braces 16 are attached between the bottom chord 12 and the upper chords 14. Similarly, truss 210 includes a bottom chord 212, upper chords 214, web braces 216 and a peak 219. Truss 310 includes a bottom chord 312, upper chords 314, web braces 316 and a peak 319. Truss 410 includes a bottom chord 412, two upper chords 414, web braces 416 and a peak 419. As will be discussed below, the spacer bars 20 may be installed such that they are located on the upper one third of the top chords as shown in FIG. 1. The reader will appreciate, however, that the spacer bars 20 could be installed at other locations on the top chords and, for longer spanning trusses, multiple rows of spacer bars could be used. It will be further understood that the present spacer bar 20 could also be effectively installed on the lower chords of trusses instead of, or in addition to, installing the spacer bars 20 on the upper chords of the trusses.

The skilled artisan will further appreciate that the spacer bar 20 of the present invention may have utility beyond use in connection with roof and floor truss components. Furthermore, as the present detailed description proceeds, the reader will appreciate that the spacer bar 20 of the present invention can be successfully used in connection with a variety of different building components that are fabricated from various materials such as metal, wood, etc. Thus, although the present invention is described herein in connection with wooden roof trusses (10, 210, 310, 410), the protection afforded thereto should not be limited solely to use in connection with such components.

FIGS. 1–12, illustrate one embodiment of the subject invention constructed for supporting three roof trusses (10, 210, 310) in a predetermined spaced-apart relationship. More particularly and with reference to FIGS. 2–9, the spacer bar 20 includes an elongated planar brace member 22 that has a planar upper surface 24 and a planar lower surface 26. Brace member 22 may be fabricated from metal such as cold rolled steel, hot rolled steel, stainless steel and aluminum. However, other materials such as wood, plastic, etc. could be successfully used. As can also be seen in FIGS. 1–5, the elongated planar brace member 22 has a first end 28 and a second end 29.

Figure 10:
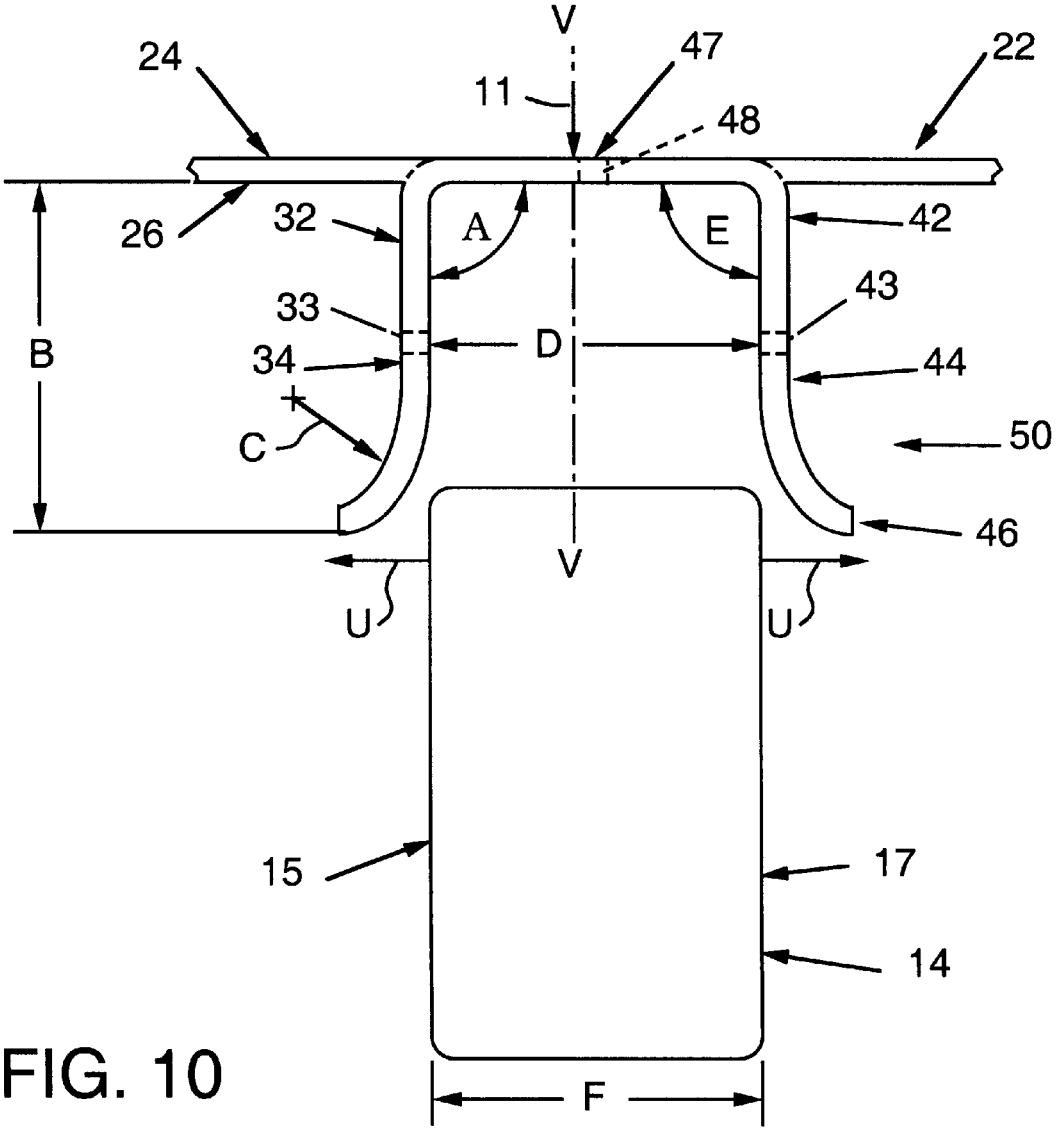
FIG. 10 is a partial front elevational view of a first pair of clamping tabs of the spacer bar of FIGS. 2–9 prior to installation on the upper chord of a roof truss.

In this embodiment, a first portion 30 adjacent the first end 28 is punched through the elongated planar brace member 22 to form a first tab 32. Those of ordinary skill in the art will appreciate such punching operation may be performed utilizing conventional metal punching techniques and apparatuses. Although in this embodiment, tab 32 is integrally formed with the elongated planar brace member 22, the reader will appreciate that the tab 32 may be provided in different shapes and comprise a separate piece of material welded or otherwise attached to the planar lower surface 26. To facilitate attachment of the tab 32 to the truss, the tab 32 may be provided with one or more fastener holes 33 therethrough for receiving an appropriate fastener (i.e., screw, nail, etc.). See FIG. 6. As can be seen in FIG. 10, the first tab 32 is bent downward from the planar lower surface 26 such that it extends substantially perpendicular thereto (i.e., angle "A" is approximately 90°). As can also be seen in FIGS. 10 and 10A, the first tab 32 has an upper portion 34 and a flared or arcuate lower portion 36. As used herein the term "flared" encompasses any curved or flared portion that is not co-planar with the upper portion 34 of the tab 32. For example, tab 32 may protrude from the lower planar surface a distance "B" which may be 1 inch long and the lower portion may be formed at a radius "C" of ¾ inch. In the alternative, the lower portion 34 may be bent at an angle relative to the upper portion 34. Thus, as used herein, the term "flared" is meant to encompass both such arrangements in addition to any arrangement wherein the lower portion 36 is not substantially coplanar with the upper portion 34.

Figure 10A:
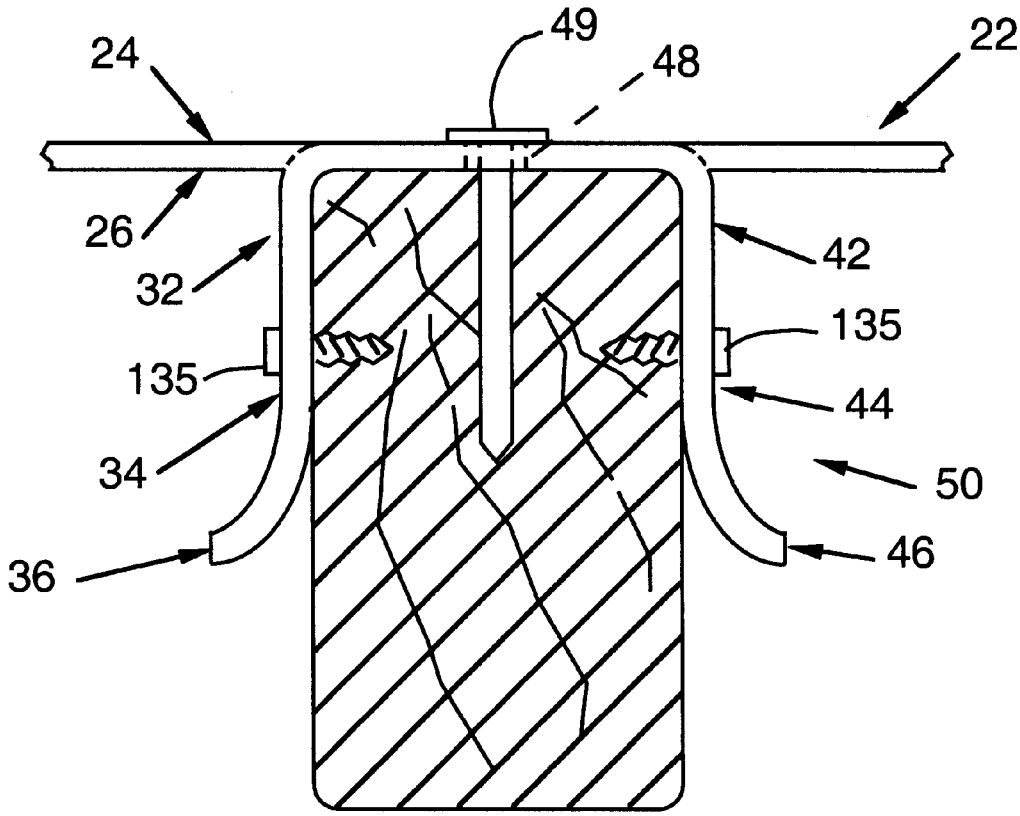
FIG. 10A is another partial front elevational view of the first pair of clamping tabs installed on the upper chord of the roof truss depicted in FIG. 10.

The subject spacer bar 20 also includes a second portion 40 that is punched from the elongated planar brace member 22 to form a second tab 42 that is spaced a first "fixed" predetermined distance "D" from the first tab 32. The term "fixed" as used herein means that the position of the second tab 42 relative to the first tab cannot be selectively changed. The second tab 42 is also bent at an angle "E" that is substantially 90° to the planar lower surface 26 of the brace member 22. The second tab 42 has an upper portion 44 and a flared lower portion 46. The flared lower portion 46 is constructed in the same manner as the flared lower portion 36 of the first tab 32. However, flared lower portions (36, 46) are bent in opposite directions to facilitate installation of the spacer bar 20 onto a structural building component such as the upper chord 14 of a roof truss 10. To facilitate attachment of the second tab 42 to the truss, one or more fastener holes 43 are provided through the tab 42 for receiving an appropriate fastener therethrough. See FIG. 10. As can be seen in FIGS. 10 and 10A, a first planar portion 47 of the planar brace member 22 extends between the first tab 32 and the second tab 42. One or more fastener openings 48 may be provided through the first planar portion 47 to enable conventional first fasteners 49 (i.e., nails, screws, etc.) to be inserted therethrough to fasten the spacer bar 20 to the truss 10 as will be described in further detail below.

Tabs (32, 42) form a first pair of integral clamping tabs collectively designated as 50. In one embodiment, the first predetermined distance "D" is slightly greater than or equal to the cross-sectional thickness "F" of the upper chord 14 of the truss 10 to be clamped thereby (i.e., "D" could range from 0–1/16 inch greater than distance "F").

Also in this embodiment, a third portion 60 is punched through the elongated planar brace member 22 to form a third rectangular shaped tab 62 that is spaced from the second tab a second "fixed" predetermined distance "G". See FIG. 5. In this embodiment, distance "G" may be, for example, 22% inches. Third tab 62 is bent downwardly from the planar lower surface 26 such that it is substantially perpendicular thereto (angle "I" is approximately 90°). See FIG. 11. The third tab 62 is formed in the same manner as the first tab 32 and has an upper portion 64 and a flared lower portion 66 and may have one or more fastener holes 63 therethrough. See FIG. 11.

A fourth portion 70 is punched from the elongated planar brace member 22 to form a fourth rectangular shaped tab 72 that protrudes substantially perpendicular from the planar lower surface 26 (angle "J" is approximately 90°) and is spaced from the third tab 62 a third predetermined distance "K". The fourth tab 72 is formed in the same manner as the second tab 42 and has an upper portion 74 and a flared lower portion 76 and may have one or more fastener holes 73 therethrough. See FIG. 11.

Tabs (62, 72) form a second pair of integral clamping tabs collectively designated as 80. In one embodiment, the third predetermined distance "K" is equal to or slightly greater than the cross-sectional thickness "L" of the upper chord 214 of the second truss 210 to be clamped thereby (i.e., distance "K" may be from 0–1/16 inch greater than distance "L").

Figure 11:
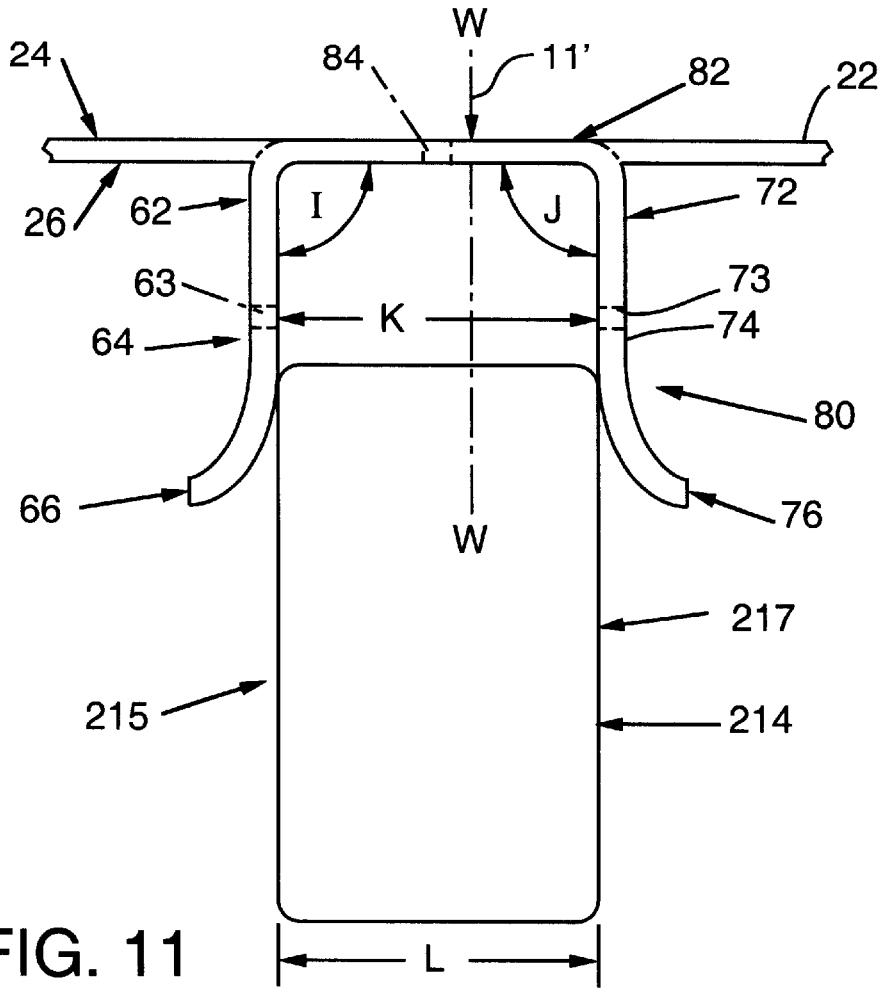
FIG. 11 is a partial front elevational view of a second pair of clamping tabs of the spacer bar of FIGS. 2–9 prior to installation on the upper chord of another roof truss.
Figure 11A:
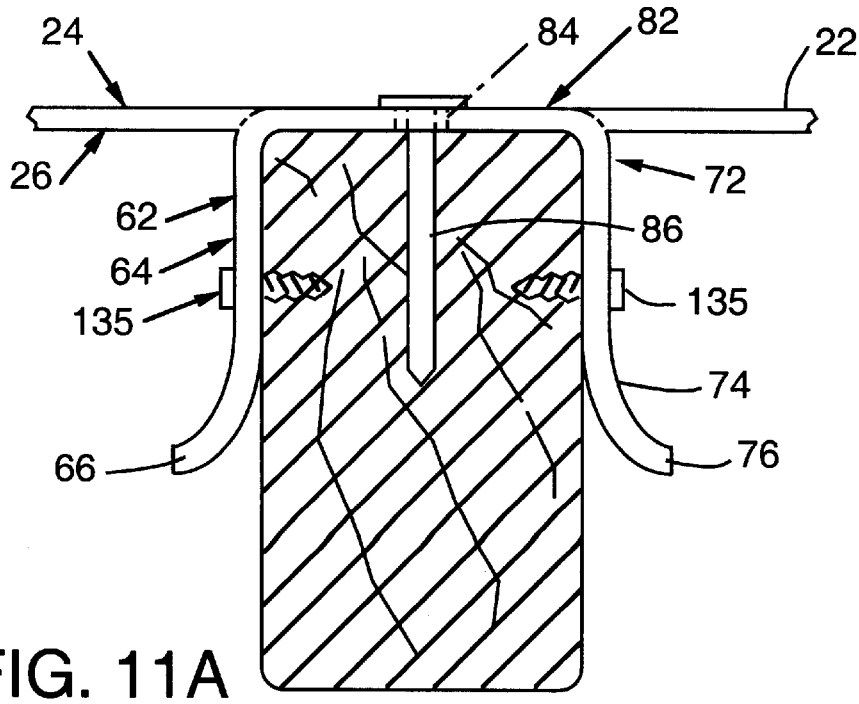
FIG. 11A is another partial front elevational view of the first pair of clamping tabs installed on the upper chord of the roof truss depicted in FIG. 11.

As can be seen in FIGS. 11 and 11A, a second planar portion 82 of the planar brace member 22 extends between the tabs (62, 72). One or more second fastener openings 84 may be provided through the second planar portion 82 to enable conventional second fasteners 86 (i.e., nails, screws, etc.) to be inserted therethrough to fasten the spacer bar 20 to the upper chord 214 of a second truss 210 as will be discussed in further detail below.

A fifth portion 110 is punched from the elongated planar brace member 22 to form a fifth rectangular shaped tab 112 that is spaced from the fourth tab 72 a fourth fixed predetermined distance "M". See FIG. 5. Fifth tab 112 is bent downwardly from the planar lower surface 26 such that it is substantially perpendicular thereto (angle "N" is approximately 90°). See FIG. 12. The fifth tab 112 is formed in the same manner as the first tab 32 and has an upper portion 114 and a flared lower portion 116 and may have one or more fastener holes 113 therethrough.

A sixth portion 120 is punched from the elongated planar brace member 22 to form a sixth rectangular shaped tab 122 that protrudes substantially perpendicular from the planar lower surface 26 (angle "O" is approximately 90°) and is spaced from the fifth tab 112 a fifth predetermined distance "P". See FIG. 12. The sixth tab 122 is formed in the same manner as the second tab 42 and has an upper portion 124 and a flared lower portion 126 and one or more fastener holes 123 therethrough.

Tabs (112, 122) form a third pair of integral clamping tabs collectively designated as 130. In one embodiment, the fifth predetermined distance "P" is equal to or greater than the cross-sectional thickness "Q" of the upper chord 314 of a third roof truss 310 (i.e., distance "p" may be approximately 0–1/16 inches greater than distance "Q")

Figure 12:
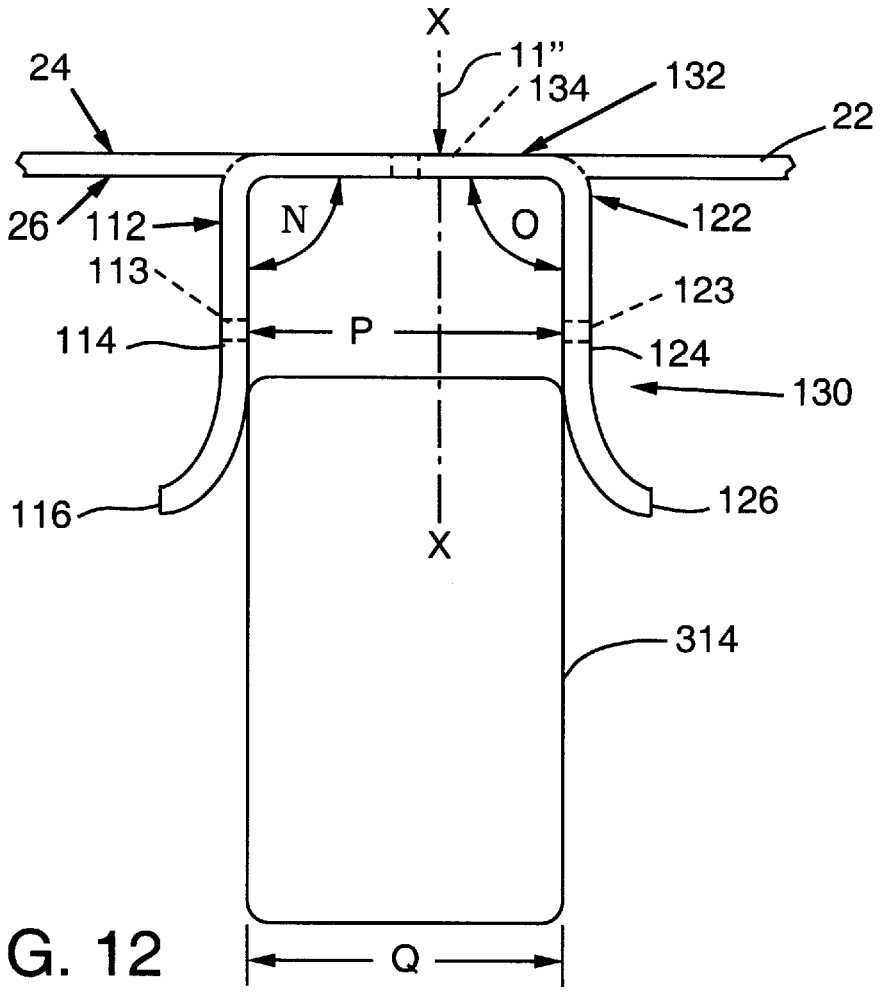
FIG. 12 is a partial front elevational view of a third pair of clamping tabs of the spacer bar of FIGS. 2–9 prior to installation on the upper chord of another roof truss.
Figure 12A:
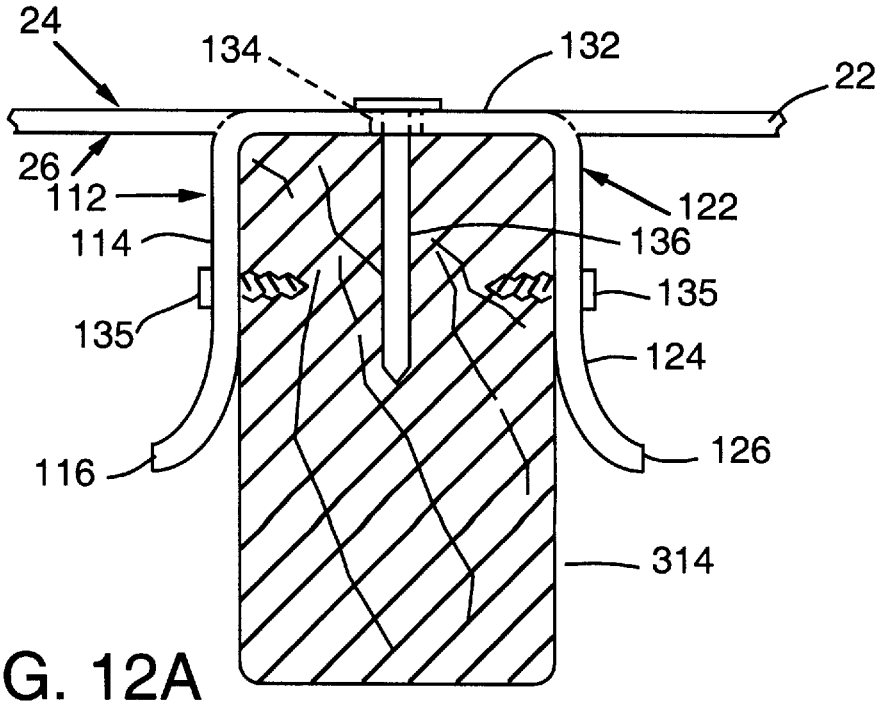
FIG. 12A is another partial front elevational view of the first pair of clamping tabs installed on the upper chord of the roof truss depicted in FIG. 12.

As can be seen in FIGS. 12 and 12A, a third planar portion 132 of the planar brace member 22 extends between the tabs (112, 122). One or more third fastener openings 134 may be provided through the third planar portion 132 to enable conventional third fasteners 136 (i.e., nails, screws, etc.) to be inserted therethrough to fasten the spacer bar 20 to a building component such as roof truss 314 in the manners discussed above.

The reader will appreciate that building components are spaced at predetermined intervals that may be dictated by the type of building structure and loading characteristics. In addition, many building codes require that the roof trusses for a residential building be spaced at two feet between their respective centers. Thus, in the embodiment depicted in FIG. 2, the distance "R" between the centers of the first and second planar portions (47, 82) and the centers of the building components clamped by the first and second pairs of clamping tabs (50, 80) may be 24 inches. Similarly, the distance "S" between the centers of the second planar portion 82 and the third planar portion 132 may also be 24 inches (distance "T" may be 48 inches). The reader will readily appreciate however, that distances could have a variety of other magnitudes.

The reader will further appreciate that the tabs (32, 42, 62, 72, 112, 122) are substantially rigid with respect to the planar brace member 22. However, if the spacer bar 20 is fabricated from the above-identified material, such material enables the tabs to flex slightly when the truss component is inserted therebetween. For example, during installation, the tabs (32, 42) may each flex outward (represented by arrows "U" in FIG. 10). Thus, the term "rigid" as used herein with respect to tabs (32, 42, 62, 72, 112, 122), means that such tabs cannot be repositioned longitudinally along the brace member 22 but rather remain affixed thereto while permitting their respective lower portions to flex slightly for installation purposes. That term also encompasses tabs that do not flex and are unable to be moved longitudinally along the brace member 22.

To provide the spacer bar 20 with laxial rigidity between the first pair of clamping tabs 50 and the second pair of clamping tabs 80, a first reinforcing member 90 may be centrally disposed in a portion 25 of the elongated planar brace member 22 that extends between the second tab 42 and the third tab 62. In this embodiment, the first reinforcing member 90 comprises a first reinforcing rib segment 92 that is integrally formed in the portion 25. More particularly and with reference to FIGS. 4 and 5, the first reinforcing rib segment 92 may comprise an arcuate rib that is centrally disposed in the portion 25. For example, in an embodiment wherein distance G' is 22½ inches, the first reinforcing rib segment 92 may be 21 inches long (distance G"). See FIGS. 3 and 4. In an embodiment wherein the elongated planar brace member 22 is 3.5 inches wide (distance X), the first reinforcing rib segment 92 may be 1.5 inches wide (distance X') and be ¾ inches deep (distance X"). The rib segment 92 may be formed with radiused edges with respect to the planar upper surface 24 of the brace member 22 (i.e., distance is approximately 0.375 inches). Those of ordinary skill in the art will appreciate, however, that other shapes and sizes of reinforcing members may be formed in or attached to the planar brace member 22 to provided additional rigidity thereto without departing from the spirit and scope of the present invention.

Similarly, to provide the spacer bar 20 with laxial rigidity between in the second pair of clamping tabs 80 and the third pair of clamping tabs 130, a second reinforcing member 140 may be centrally disposed in a portion 142 of the elongated planar brace member 22 that extends between the fourth tab 72 and the fifth tab 112. In this embodiment, the second reinforcing member 140 comprises a second reinforcing rib segment 144 that is integrally formed in the portion 142 and is sized similarly to the first reinforcing rib 92 as described above. Those of ordinary skill in the art will appreciate, however, that other shapes and sizes of reinforcing members may be formed in or attached to the planar brace member 22 to provide additional rigidity thereto without departing from the spirit and scope of the present invention.

The use and installation of the spacer bar 20 can be understood from reference to FIGS. 1, 10, 10A, 11, 11A, 12, and 12A. In this example, a single spacer bar 20 is used to support three roof trusses (10, 210, 310) that are supported on two support walls (18, 18'). As can be seen in FIG. 1, the bottom chords (12, 212, 312) of the trusses (10, 210, 310) are supported on edge on the support walls (18, 18'). The reader will appreciate that the ends of the trusses (10, 210, 310) are also typically braced in accordance with standard practices. The center of bottom chord 12 is spaced from the center of the bottom chord 212 a desired distance that is equivalent to the distance between the center of the first planar portion 47 and the second planar portion 82 of the spacer bar 20. Likewise, the center of bottom chord 312 is spaced from the center of bottom chord 212 a desired distance that is equivalent to the distance between the center of the second planar portion 82 and the center of the third planar portion 132. The trusses (10, 210, 310) are anchored to the support walls (18, 18') using conventional techniques. In accordance with standard practice, one or more of the trusses are supported by one or more diagonal braces that extend between the truss and the ground or some other rigid structure. Typically, at least one of the end-most trusses is braced with a diagonal brace. It will be appreciated that such a diagonal brace (not shown) prevents that truss from toppling over. Thus, in FIG. 1, the truss 310 may be supported by a diagonal brace that is attached to a portion of the truss 310 and extends to the ground. Thereafter, a first spacer bar 20 is oriented relative to a portion of the upper chord of truss 10 such that the first tab 32 is adjacent side 15 of the upper chord 14 of the first truss 10 and the second tab 42 is adjacent the other side 17 of the upper chord 14 of the first truss 10. See FIG. 10. Similarly, the third tab 62 is adjacent side 215 of the upper chord 214 of the second truss 210 and the fourth tab 72 is adjacent the other side 217 of the upper chord 214 of the second truss 210 as shown in FIG. 11. Likewise, the fifth tab 112 is adjacent the side 315 of the upper chord 314 of the third truss 310 and the sixth tab 132 is adjacent the other side 317 of the upper chord 314 of the third truss 310 as shown in FIG. 12.

The upper chord 14 of the truss is inserted between the first pair of clamping tabs 50 by applying a first transverse force 11 to the first planar portion 47. See FIG. 10. Such force may be applied along an axis V—V that is substantially perpendicular to the upper surface of the chord 14 by hitting the upper planar portion 47 with a hammer or other appropriate tool. The reader will appreciate that, when the inside surfaces of the flared lower portion 36 of the first tab 32 and the flared lower portion 46 of the second tab 42 may, depending upon the spacing between the tabs and the thickness of the upper chord 14, direct the tabs (32, 42) slightly outward (represented by arrows "U") to enable the upper chord 14 to be clamped between the tabs (32, 42). The force is applied until the portion of the planar lower surface 26 of the brace 22 that corresponds to the first planar portion 47 contacts the upper surface of the upper chord 14 and is substantially parallel thereto. See FIG. 10A. The reader will appreciate that when the first pair of clamping tabs 50 is initially aligned in the above-mentioned manner that the third tab 62 will be substantially adjacent to side 215 of the upper chord 214 of the second truss 210 and the fourth tab 72 will be adjacent to the other side 217 of the upper chord 214 of the second truss 210. See FIG. 11.

The application of the first force 11 to the first planar portion 47 may also cause the second truss 210 to be clampingly engaged between the third tab 62 and the fourth tab 72. However, if the spacer bar 20 is not completely seated such that the lower surface of the second planar portion 82 is not contacting the upper surface of the upper chord 214 of the second truss 210 (FIG. 11A), a second force 11' may be applied to the second planar portion 82 in the above-described manner. The additional force 11' is similarly applied to the second planar portion 82 by hammer or other tool such that it is applied along an axis W—W that is substantially perpendicular to the upper surface of the chord 214. Such force is applied until the portion of the planar lower surface 26 of the brace member 22 contacts the upper surface of the chord 214 and is substantially parallel thereto. See FIG. 11A.

The application of the first and second forces (11, 11') to the first and second planar portions (47, 82) may also cause the third truss 310 to be clampingly engaged between the fifth tab 112 and the sixth tab 122. However, if the spacer bar 20 is not completely seated such that the lower surface of the second planar portion 132 is not contacting the upper surface of the upper chord 314 of the second truss 210 (FIG. 12A), a third force 11" may be applied to the third planar portion 132 in the above-described manner. The additional force 11" is similarly applied to the third planar portion 132 by hammer or other tool such that it is applied along an axis X—X that is substantially perpendicular to the upper surface of the chord 314. Such force is applied until the portion of the planar lower surface 26 of the brace member 22 contacts the upper surface of the chord 314 and is substantially parallel thereto. See FIG. 12A.

The reader will appreciate that, after the spacer bar 20 has been installed in the above-described manner, the trusses (10, 210, 310) will be stabilized and supported in the desired spaced-apart relationship relative to each other, to enable additional trusses to be installed without risk of trusses (10, 210, 310) toppling over, provided that at least one of the trusses has been braced with one or more diagonal braces. For installations having a large number of trusses, more than one truss is typically braced with one or more diagonal braces to prevent unwanted toppling of the trusses.

After the spacer bar 20 has been installed as described, first fasteners 49 such as screws, nails, etc. may be inserted through the first fastener openings 48 to further affix the spacer bar 20 to the first truss 10. Additional fasteners 135 may be inserted through the fastener openings in the tabs (34, 44) if desired. Similarly, the spacer bar 20 may be further affixed to the second truss 210 by inserting second fasteners 86 (nails, screws, etc.) through the second fastener holes 84 in the second planar portion 82 and fasteners 135 through at least one second fastener opening in each of the tabs (62, 72). Likewise, third fasteners 136 may be inserted through third fastener holes 134 in the third planar portion 132 to affix the spacer bar 20 to the third truss 310 and, if desired, fasteners 135 may be inserted through fastener openings in the tabs (112, 122).

The reader will further appreciate, however, that the spacer bar 20 of the present invention could also be installed on the trusses without the use of fasteners. That is, the spacer bar may be installed over the trusses in the above-described manner without inserting nails, screws, and etc. through the fastener holes. The spacer bar will support the trusses in the desired upright position and at the desired spacing arrangement and the sheathing or other material may be installed over the spacer bar.

After the first three trusses (10, 210, 310) have been installed, another spacer bar 20 may be employed in the above manner to support an additional truss 410. For example, as shown in FIG. 1, a second spacer bar 20 is affixed between the first truss 10 and a fourth truss 310 and a fifth truss (not shown) in the manner described above. However, as can be seen in FIG. 1, the second spacer bar 20 is staggered from the first spacer bar 20. After the trusses and the spacer bars 20 have been installed in the above-described manner, appropriate decking materials, roofing materials, floor materials, etc. may be affixed to the upper chords of the trusses. One method of installing the spacer bars 20 of the present invention includes locating the spacer bars on the upper one third of the upper truss chords. Those of ordinary skill in the art will further appreciate that when a truss located at an end of a structure is installed, the spacing between that end truss and the adjacent truss may sometimes be less than the relatively uniform spacing between the other trusses. The spacer bar of the present invention may be effectively employed in these situations by installing the clamping tabs on the adjacent trusses that are equally spaced from each other and cutting the portion of the brace 22 extending between the next-to-last truss and the end truss such that the spacer brace does not undesirably extend past the end truss. The end of the spacer brace 22 may then be affixed to the end truss by passing one or more fasteners (i.e., nail, screw) through the spacer brace and into the end truss. Thus, the spacer bar of the present invention can accommodate such situations wherein the spacing between the end truss and the other trusses is not the same as the spacing between the other trusses (and the sets of clamping tabs).

Figure 13:
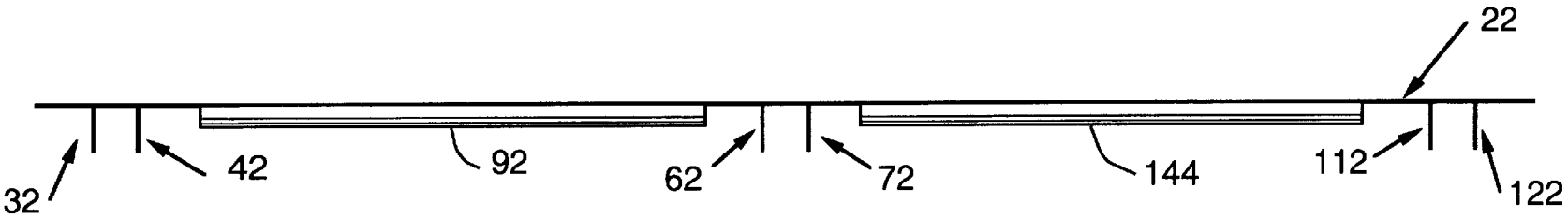
FIG. 13 is a front elevational view of another spacer bar of the present invention.
Figure 14:
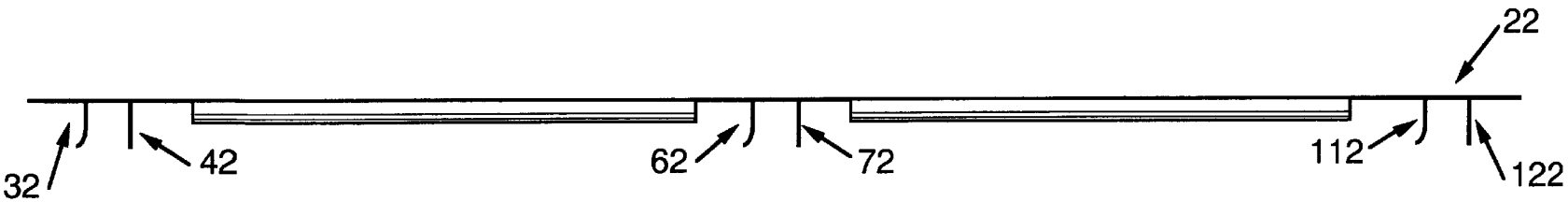
FIG. 14 is a front elevational view of yet another spacer bar of the present invention.

The reader will appreciate that the flared ends of the tabs serve to help guide the tabs into clamping engagement with the respective truss during installation. While each of the tabs of the above-described embodiment has a flared lower portion, the reader will appreciate that the tabs (32, 42, 62, 72, 112, 122) may be provided with no lower flared portions (FIG. 13) or just one of the tabs (32, 42, 62, 72, 112, 122) of each pair (50, 80, 130) may be provided with a flared lower portion (FIG. 14).

Figure 15:
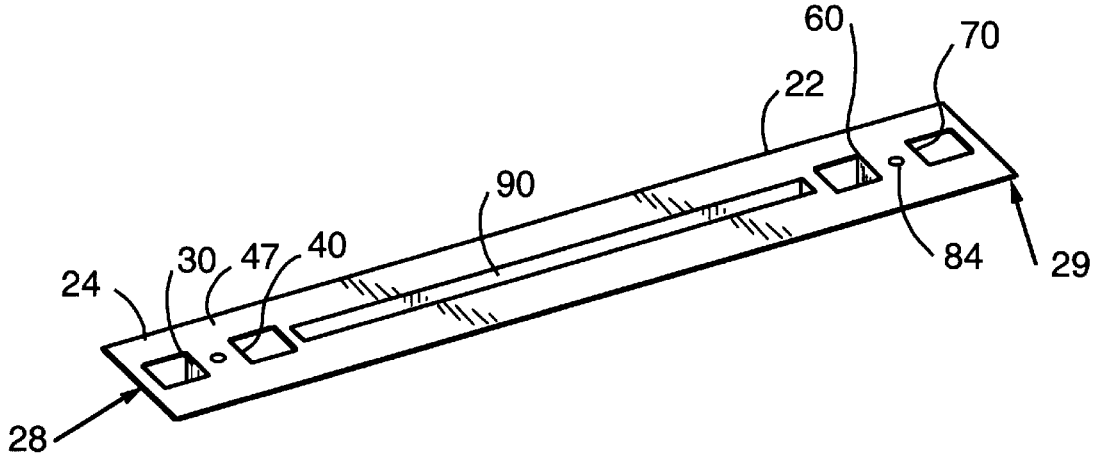
FIG. 15 is a perspective view of another spacer bar of the present invention.
Figure 16:
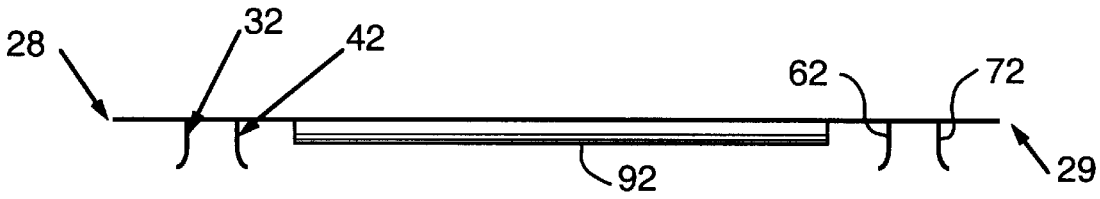
FIG. 16 is a front elevational view of the spacer bar of FIG. 15.

Another embodiment of the present invention is depicted in FIGS. 15 and 16. This embodiment is identical in construction to the spacer bar 20 above except that it only has the clamping tabs 50 and 80 for clamping two building components or trusses (10, 210). The reader will appreciate that this embodiment of the present spacer bar is also installed in the above-described manner.

Figure 17:
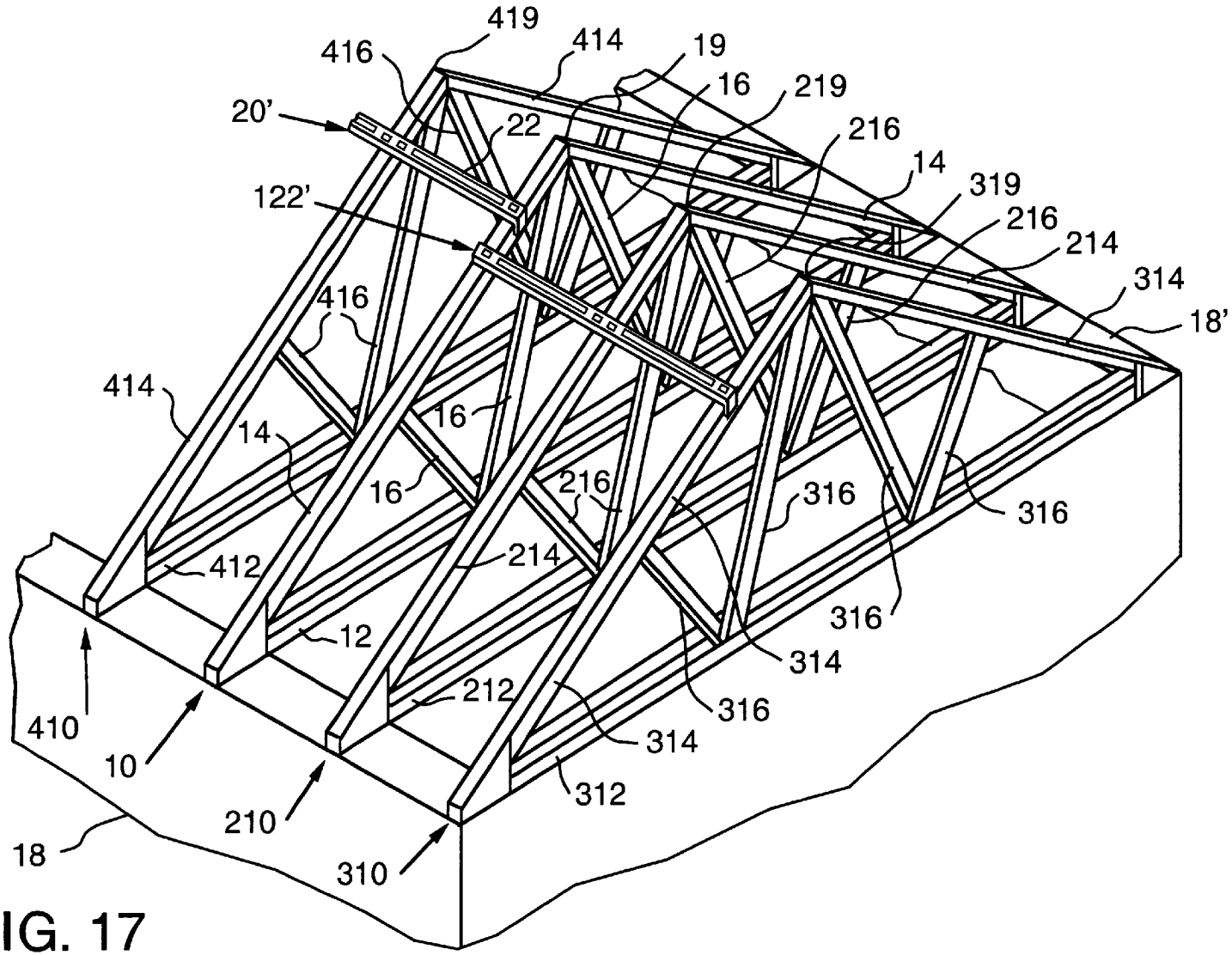
FIG. 17 is a perspective view of two other spacer bars of the present invention supporting a plurality of roof trusses on support walls.
Figure 18:
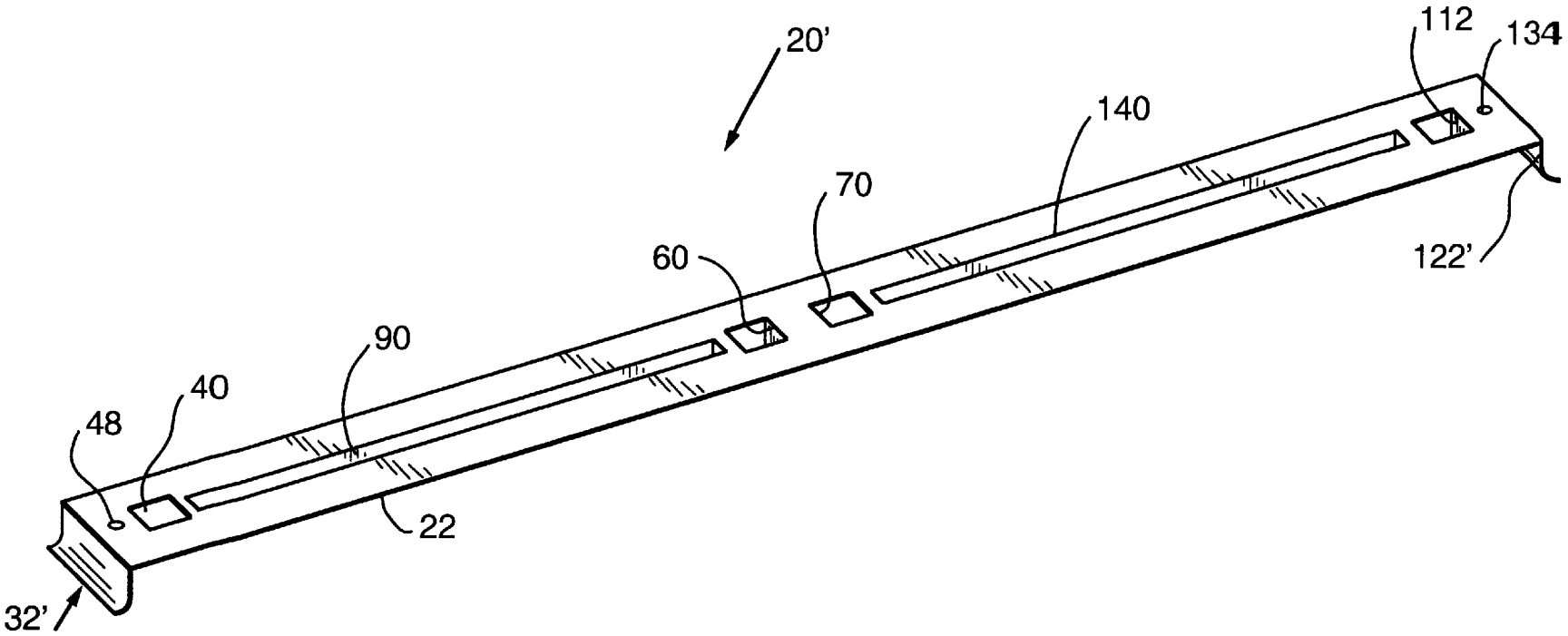
FIG. 18 is a perspective view of another spacer bar of the present invention.
Figure 19:
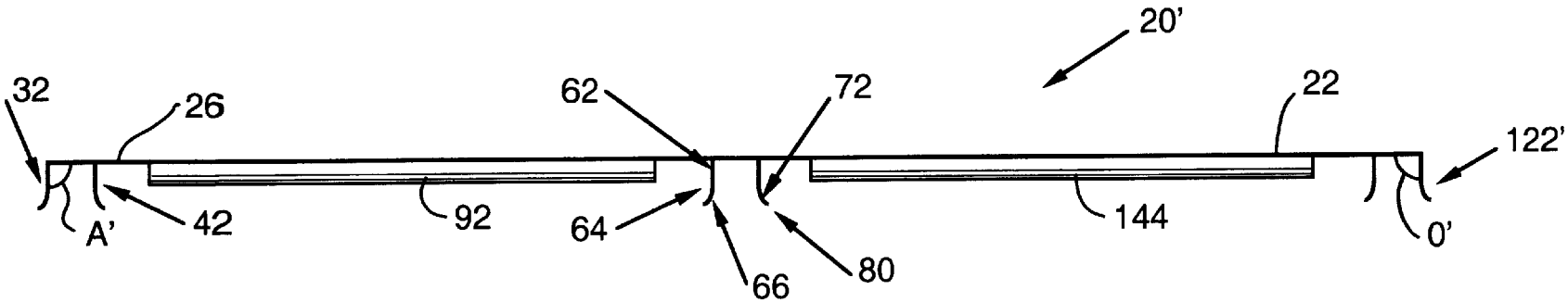
FIG. 19 is a front elevational view of the spacer bar of FIG. 18.
Figure 24:
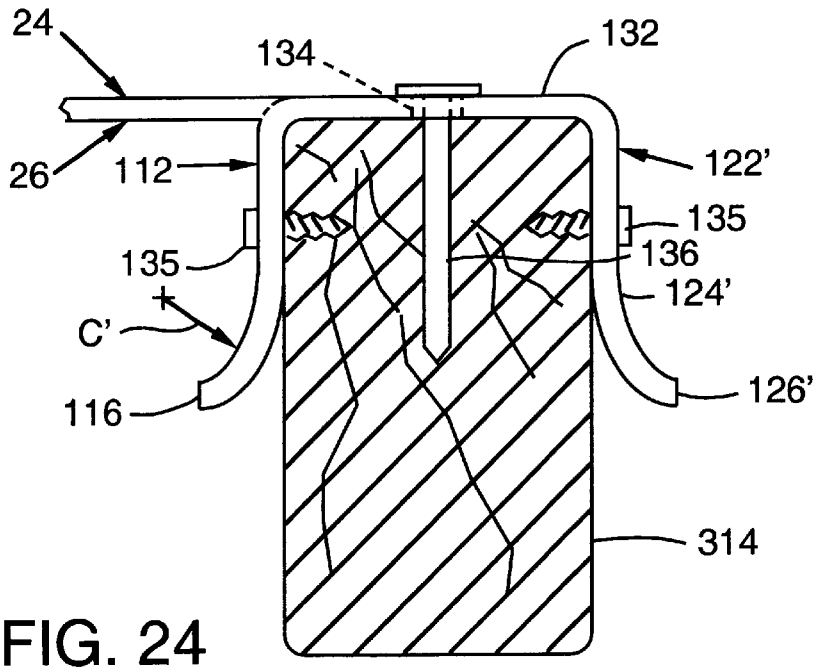
FIG. 24 is a partial front elevational view of a pair of clamping tabs installed on the upper chord of the roof truss depicted in FIG. 17.
Figure 20:
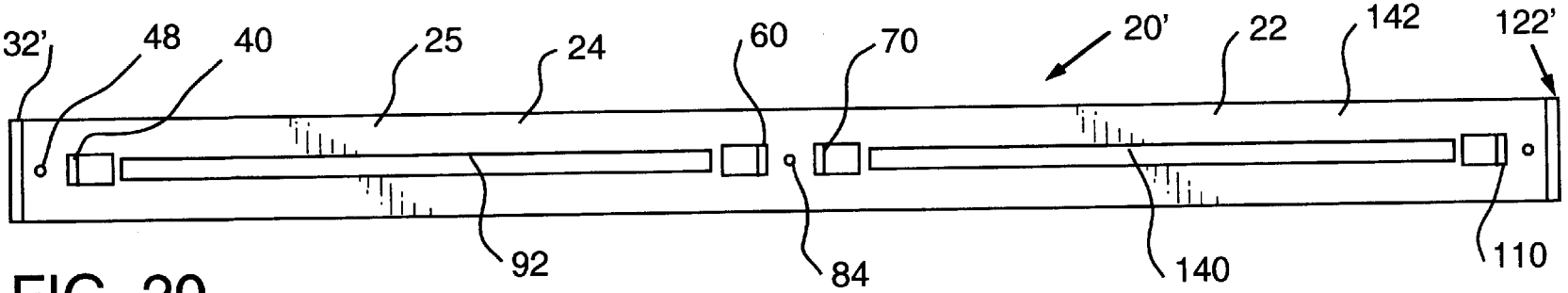
FIG. 20 is a top view of the spacer bar of FIGS. 18 and 19.
Figure 21:
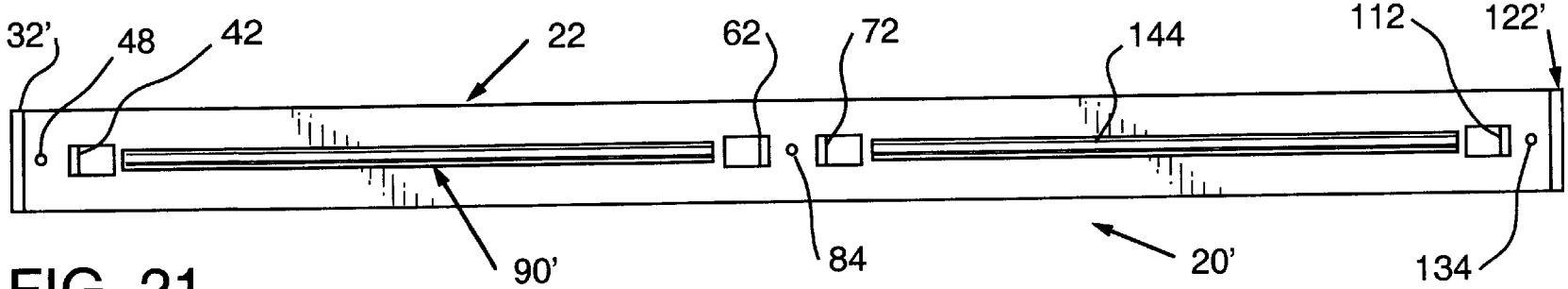
FIG. 21 is a bottom view of the spacer bar of FIGS. 18–20.
Figure 23:
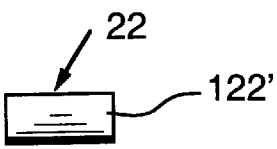
FIG. 23 is a right end elevational view of the spacer bar of FIGS. 18–22.
Figure 22:
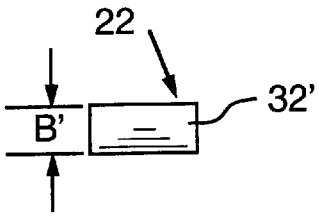
FIG. 22 is a left end elevational view of the spacer bar of FIGS. 18–21.

Yet another embodiment of the spacer bar of the present invention is depicted in FIGS. 17–24. This embodiment is essentially identical in construction to the spacer bar 20 as described above (and is designated as 20'), except that the end tabs designated as 32' and 120' are formed by bending the entire end of the brace member 22 such that it is substantially perpendicular to the brace member 22. Thus, as can be seen in FIGS. 17–22, the end tab 32' is bent substantially perpendicular to the planar lower surface 26 (i.e., angle A' is approximately 90°) and end tab 120 is also bent substantially perpendicular to the lower surface 26 such that angle O' is approximately 90°. End tab 32' may have an upper portion 34' and a flared or arcuate lower portion 36'. Tab 32' may protrude from the lower planar surface a distance B' which may be one inch long and the lower portion may be formed at a radius C' of ¾ inch. Similarly, in this embodiment, end tab 120' has an upper portion 124' and a flared lower portion 126. While in this embodiment, the end tabs (32', 120') are formed from the ends of the brace member 22, the person of ordinary skill in the art will appreciate that the end tabs may be formed by welding or otherwise attaching tabs to the brace member 22. As can be seen in FIGS. 17 and 24, the spacer bar 20 is used and installed in the manners described above with respect to spacer bar 20.

Figure 25:
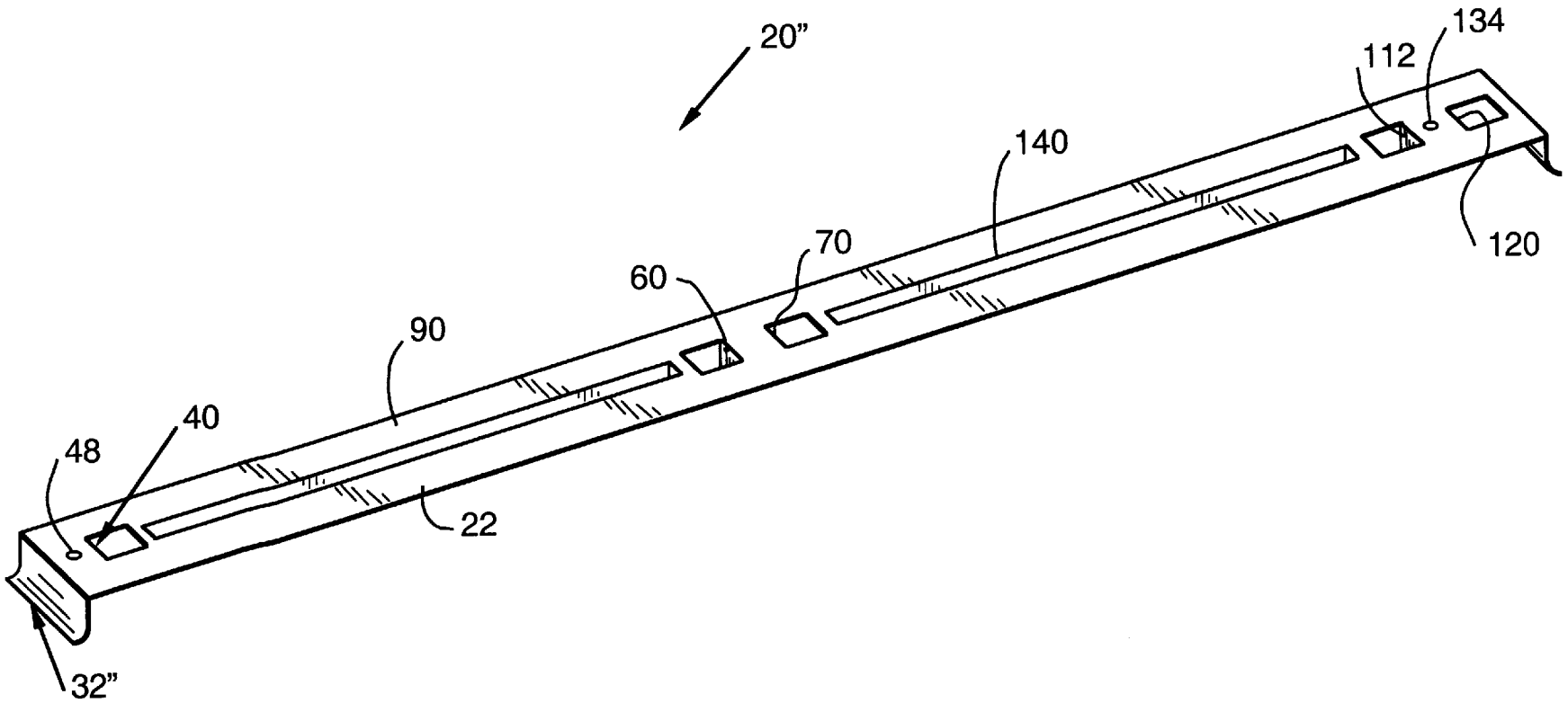
FIG. 25 is a perspective view of another spacer bar of the present invention.
Figure 26:
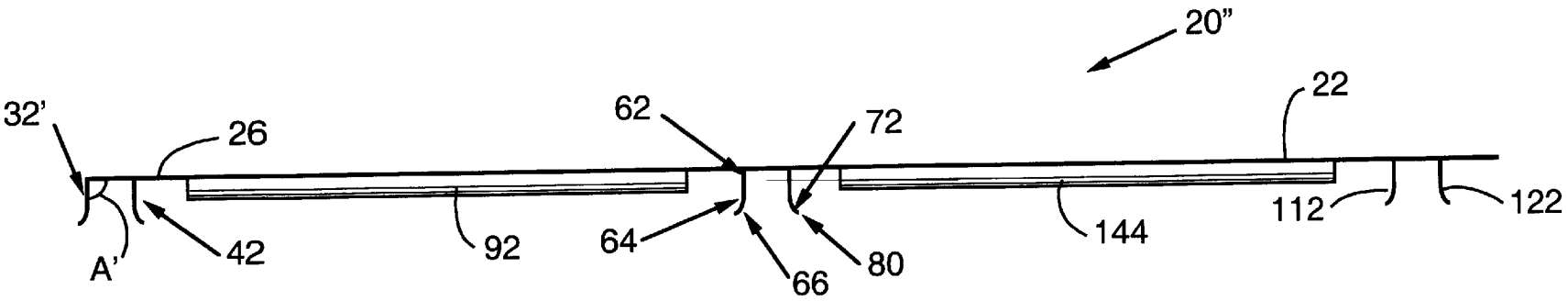
FIG. 26 is a front elevational view of the spacer bar of FIG. 25.
Figure 27:
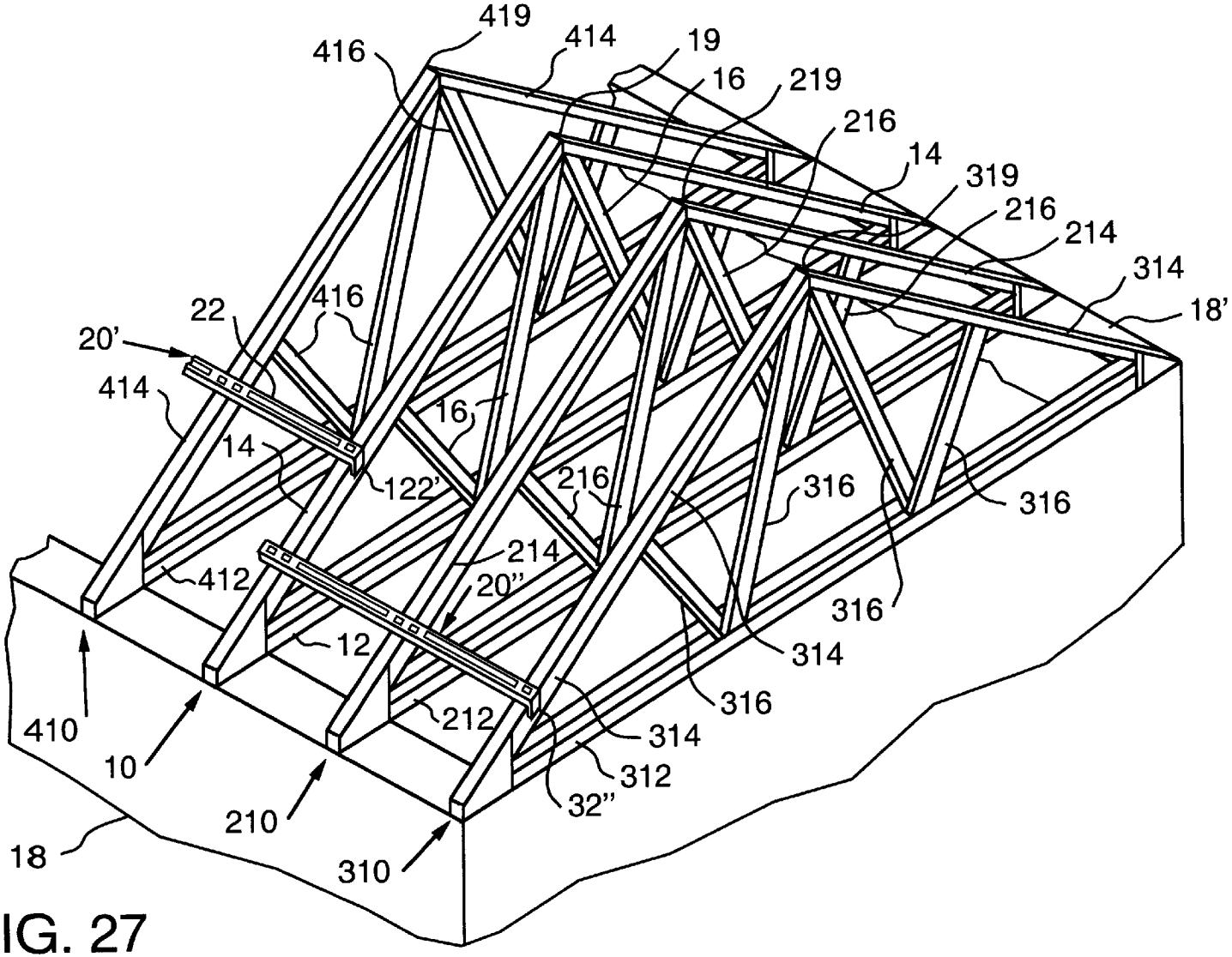
FIG. 27 is a perspective view of two other spacer bars of the present invention supporting a plurality of roof trusses on support walls.
Figure 28:
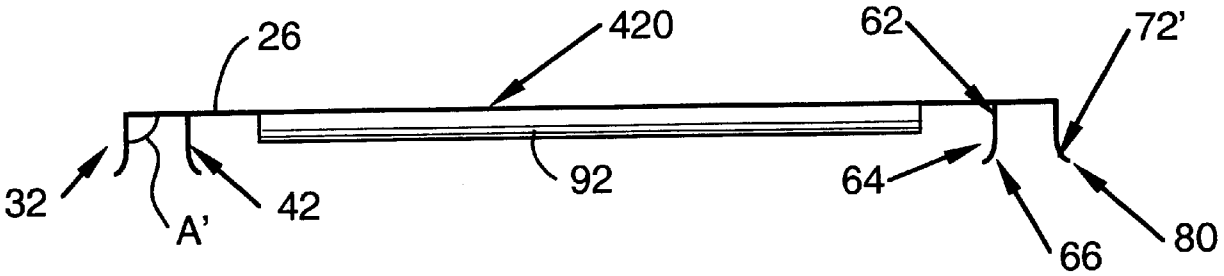
FIG. 28 is a front elevational view of another spacer bar embodiment of the present invention.

An alternative embodiment of the spacer bar (designated as 20") is depicted in FIGS. 25–27. As can be seen in those Figures, only one of the end tabs (i.e., tab 32") is formed from the end of the spacer bar 22. The other end of the spacer bar 20" is formed in the manner described above. The remaining portion of the spacer bar 20" is essentially identical to corresponding portions of spacer bar 20. Thus, the end tab 32" may be clamped onto a last truss as shown in FIG. 27. The spacer bars depicted in FIGS. 17–27 are constructed to accommodate three building components such as upper truss chords. However, the person of ordinary skill in the art will appreciate that the spacer bars may be constructed to accommodate various numbers of building components. For example, FIG. 28 illustrates another embodiment of the spacer bar of the present invention designated as 420 that is constructed like the spacer bar depicted in FIGS. 18–23, except that it is adapted to accommodate two building components. In particular, the end tabs (32', 72') are formed in the opposite ends of the end of the spacer bar 420.

Yet another embodiment of the present invention is depicted in FIGS. 29–39. In this embodiment, the spacer bar 520 includes an elongated planar brace member 522 that has a planar upper surface 524 and a planar lower surface 526. See FIGS. 33 and 34. Brace member 522 may be fabricated from metal such as cold rolled steel, hot rolled steel, stainless steel and aluminum. However, other materials such as wood, plastic, etc. could be successfully used. As can also be seen in FIGS. 29–34, the elongated planar brace member 522 has a first end 528 and a second end 529.

Figure 30:
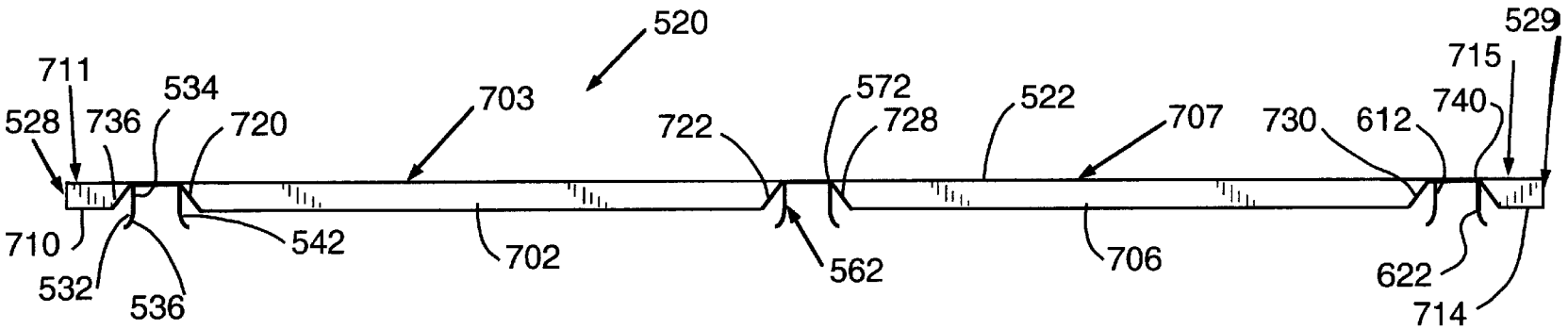
FIG. 30 is a front elevational view of the spacer bar of FIG. 29.

In this embodiment, a first portion 530 adjacent the first end 528 is punched through the elongated planar brace member 522 to form a first tab 532. Those of ordinary skill in the art will appreciate such punching operation may be performed by utilizing conventional metal punching techniques and apparatuses. Although in this embodiment, tab 532 is integrally formed with the elongated planar brace member 522, the reader will appreciate that the tab 532 may be provided in different shapes and comprise a separate piece of material welded or otherwise affixed to the planar lower surface 526. To facilitate attachment of the tab 532 to the truss, the tab 532 may be provided with one or more fastener holes 533 therethrough for receiving an appropriate fastener (i.e., screws, nails, etc.). See FIG. 34. As can be seen in FIG. 30, the first tab 532 is bent downward from the planar lower surface 526 such that it extends substantially perpendicular thereto. First tab 532 may be one inch long. As can also be seen in FIGS. 36 and 36A, the first tab 532 has an upper portion 534 and a flared or arcuate lower portion 536. As used herein the term "flared" encompasses any curved or flared portion that is not co-planar with the upper portion 534 of the tab 532. Tab 532 may be manufactured as described above with respect to tab 32.

Figure 36:
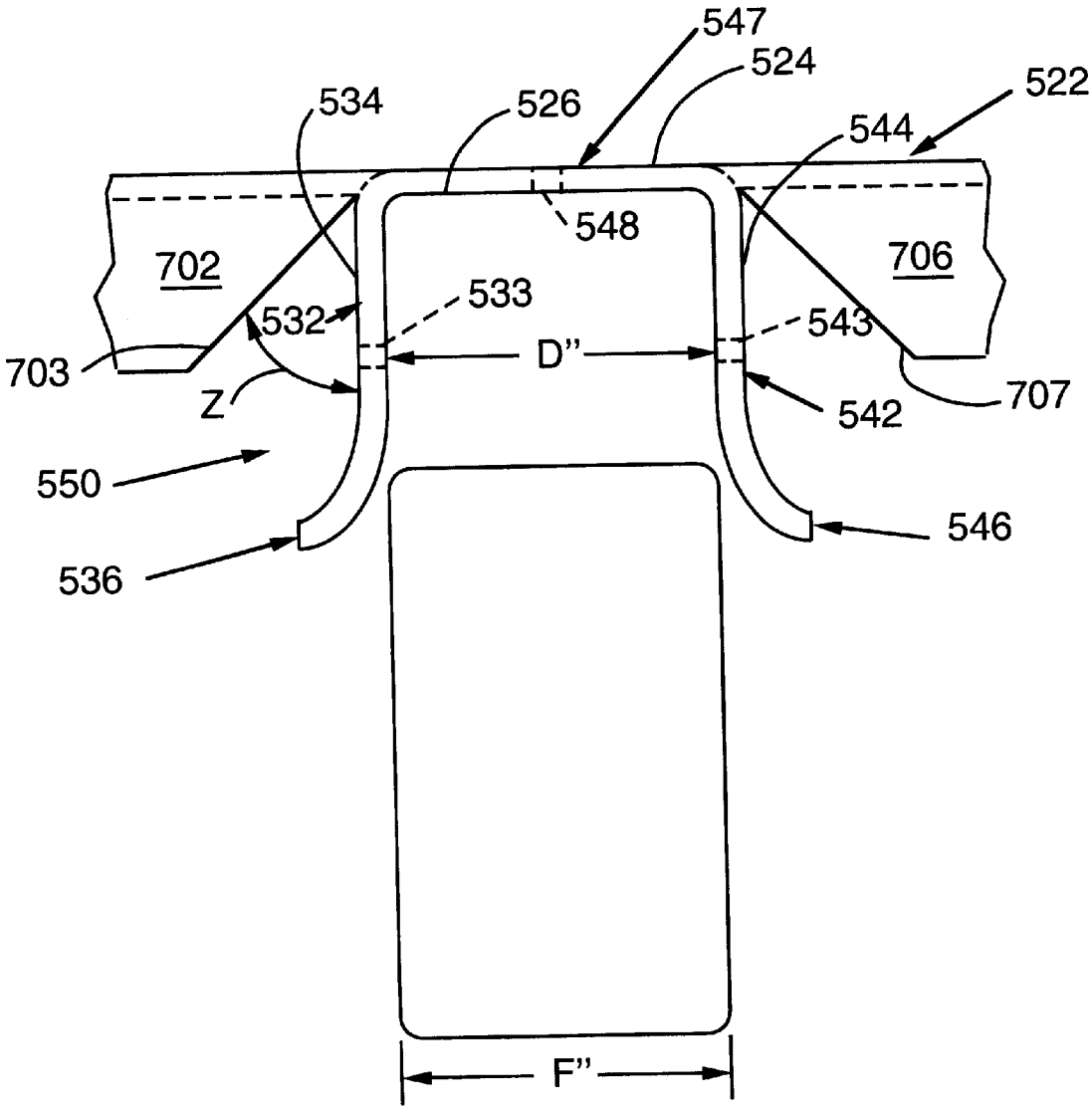
FIG. 36 is a partial front elevational view of a first pair of clamping tabs of the spacer bar of FIGS. 29–35 prior to installation on the upper chord of a roof truss.
Figure 36A:
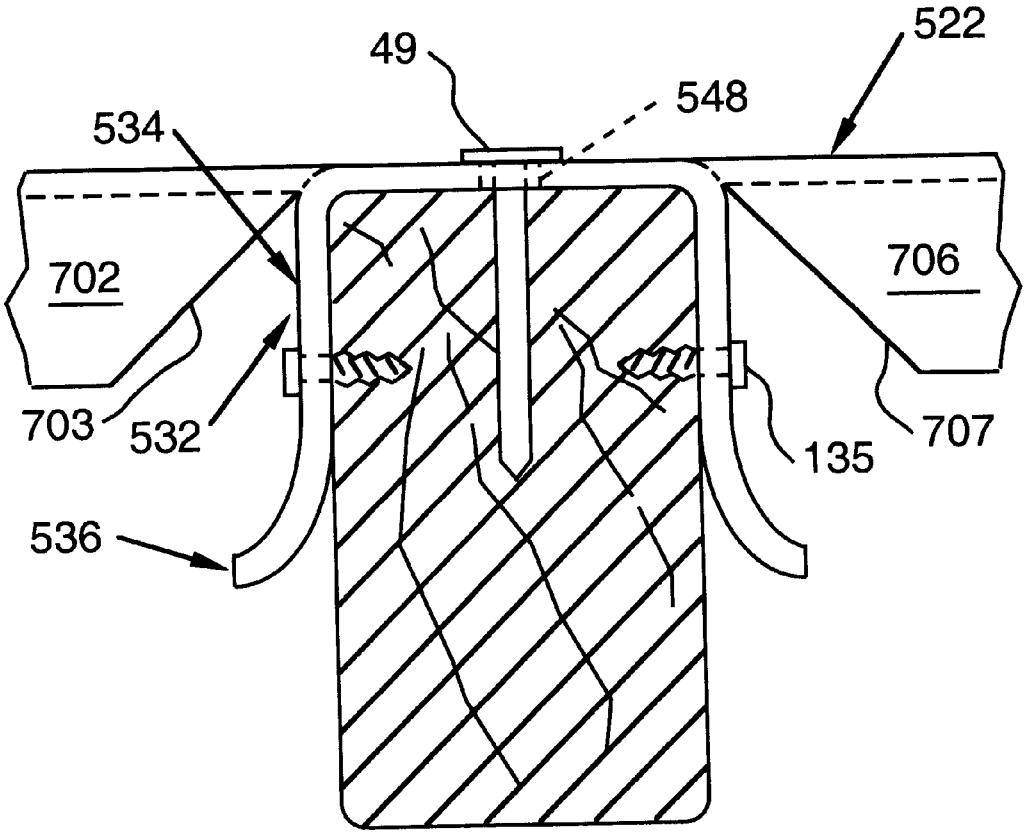
FIG. 36A is another partial front elevational view of the first pair of clamping tabs installed on the upper chord of the roof truss depicted in FIG. 36.

The subject spacer bar 520 also includes a second portion 540 that is punched from the elongated planar brace member 522 to form a second tab 542 that is spaced a first "fixed" predetermined distance "D"" from the first tab 532. The second tab 542 is also bent at an angle that is substantially 90° to the planar lower surface 526 of the brace member 522 and may be one inch long. The second tab 542 has an upper portion 544 and a flared lower portion 546 and may be constructed in the manner described above with respect to tab 542. To facilitate attachment of the second tab 542 to the truss, one or more fastener holes 543 are provided through the tab 542 for receiving an appropriate fastener therethrough. See FIG. 36. As can be seen in FIGS. 36 and 36A, a first planar portion 547 of the planar brace member 522 extends between the first tab 532 and the second tab 542. One or more fastener openings 548 may be provided through the first planar portion 547 to enable conventional first fasteners 49 (i.e., nails, screws, etc.) to be inserted therethrough to fasten the spacer bar 520 to the truss 10 as will be described in further detail below.

Tabs (532, 542) form a first pair of integral clamping tabs collectively designated as 550. In one embodiment, the first predetermined distance "D"" is slightly greater than or equal to the cross-sectional thickness "F" of the upper chord 14 of the truss 10 to be clamped thereby (i.e., "D"" could range from 0–1/16 inches greater than distance "F").

Also in this embodiment, a third portion 560 is punched through the elongated planar brace member 522 to form a third rectangular shaped tab 562 that is spaced from the second tab 542 a second "fixed" predetermined distance "G"". See FIG. 33. In this embodiment, distance "G"" may be, for example, 22½ inches. Third tab 562 is bent downwardly from the planar lower surface 526 such that it is substantially perpendicular thereto. The third tab 562 may be formed in the same manner as tab 62 and has an upper portion 564 and a flared lower portion 566 as described above and may have one or more fastener holes 63 therethrough. See FIGS. 37 and 37A.

A fourth portion 570 is punched from the elongated planar brace member 522 to form a fourth rectangular shaped tab 572 that protrudes substantially perpendicular from the planar lower surface 526 and is spaced from the third tab 562 a third predetermined distance "K"". The fourth tab 572 is formed in the same manner as the second tab 542 and has an upper portion 574 and a flared lower portion 576 and may have one or more fastener holes 573 therethrough. See FIG. 37.

Tabs (562, 572) form a second pair of integral clamping tabs collectively designated as 580. In one embodiment, the third predetermined distance "K"" is equal to or slightly greater than the cross-sectional thickness "L" of the upper chord 214 of the second truss 210 to be clamped thereby (i.e., distance "K"" may be from 0–1/16 inches greater than distance "L").

Figure 37:
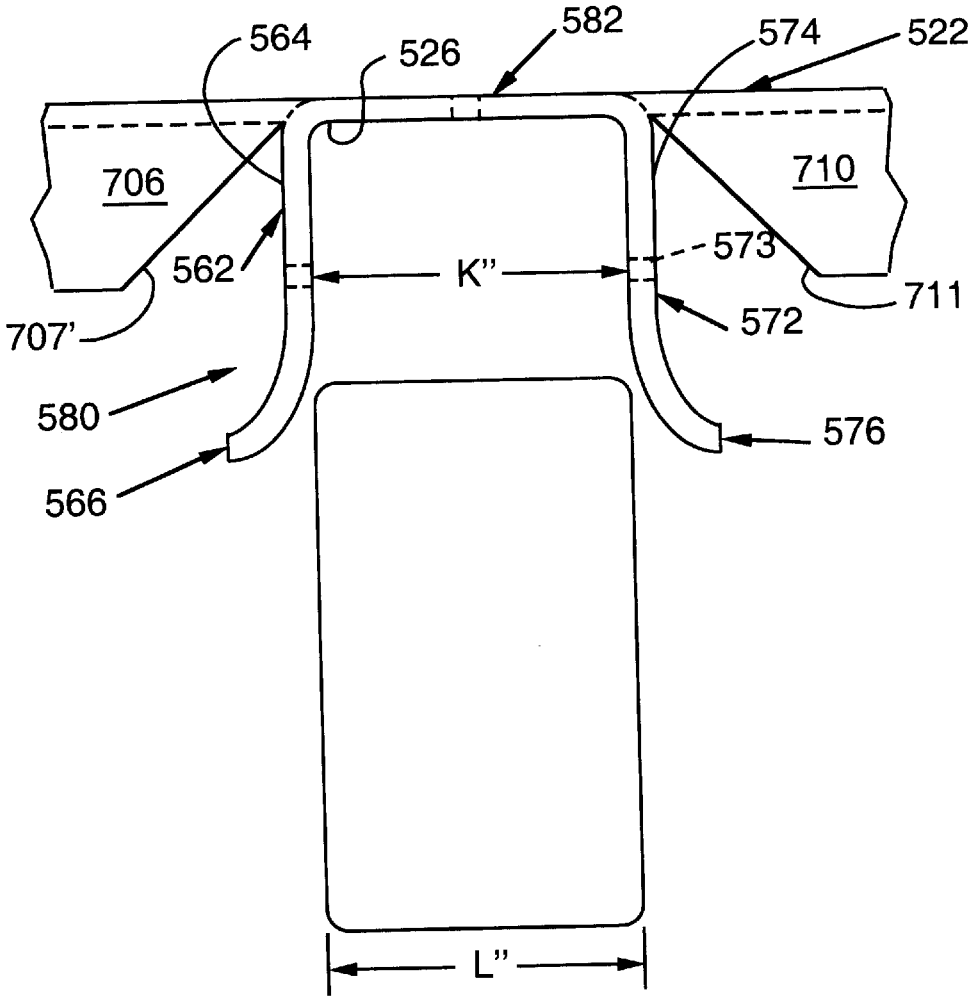
FIG. 37 is another partial front elevational view of the second pair of clamping tabs of the spacer bar of FIGS. 29–36 prior to installation on the upper chord of the roof truss.
Figure 37A:
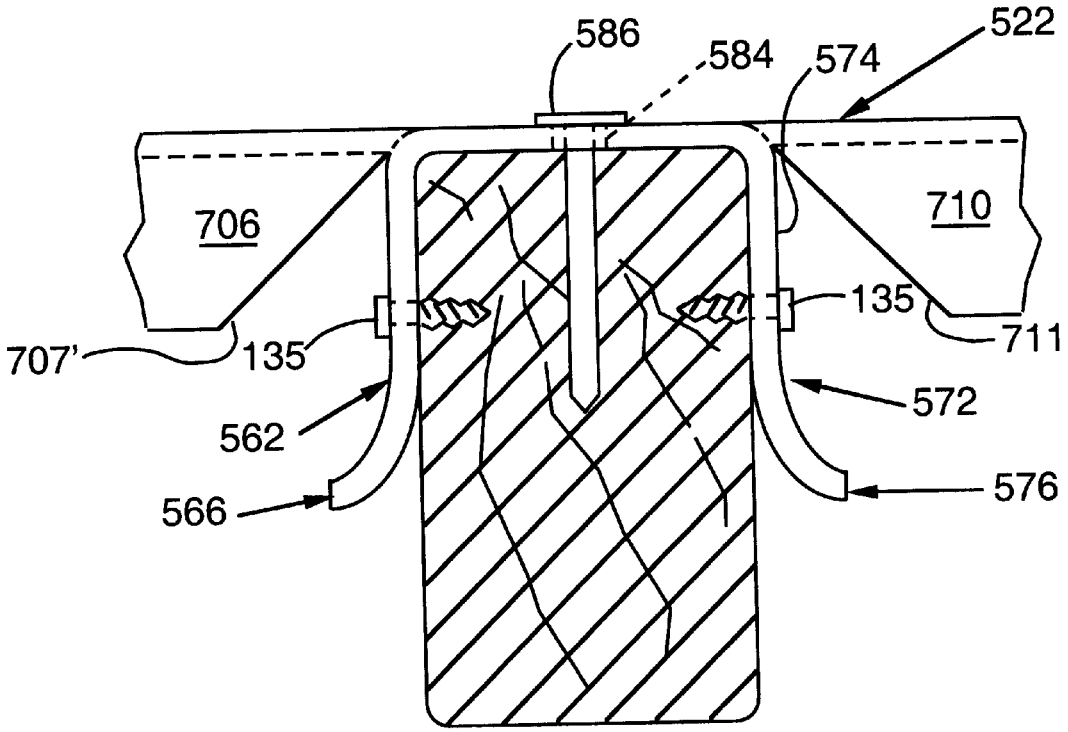
FIG. 37A is another partial front elevational view of the second pair of clamping tabs installed on the upper chord of the roof truss depicted in FIG. 37.

As can be seen in FIGS. 37 and 37A, a second planar portion 582 of the planar brace member 522 extends between the tabs (562, 572). One or more second fastener openings 584 may be provided through the second planar portion 582 to enable conventional second fasteners 586 (i.e., nails, screws, etc.) to be inserted therethrough to fasten the spacer bar 520 to the upper chord 214 of a second truss 210 in the manner described above.

A fifth portion 610 is punched from the elongated planar brace member 522 to form a fifth rectangular shaped tab 612 that is spaced from the fourth tab 572 a fourth fixed predetermined distance "M". Fifth tab 612 is bent downwardly from the planar lower surface 526 such that it is substantially perpendicular thereto and may be constructed in the same manner as tab 112 as described above. See FIGS. 38 and 38A. The fifth tab 612 is formed in the same manner as the first tab 532 and has an upper portion 614 and a flared lower portion 616 and may have one or more fastener holes 613 therethrough.

A sixth portion 620 is punched from the elongated planar brace member 522 to form a sixth rectangular shaped tab 622 that protrudes substantially perpendicular from the planar lower surface 626 and is spaced from the fifth tab 612 a fifth predetermined distance ""P"". See FIG. 38. The sixth tab 622 is formed in the same manner as the second tab 542 and has an upper portion 624 and a flared lower portion 626 and one or more fastener holes 623 therethrough.

Tabs (612, 622) form a third pair of integral clamping tabs collectively designated as 630. In one embodiment, the fifth predetermined distance "P" is equal to or greater than the cross-sectional thickness "Q" of the upper chord 314 of a third roof truss 310 (i.e., distance "P" may be 0–1/16 inch greater than distance "Q").

Figure 38:
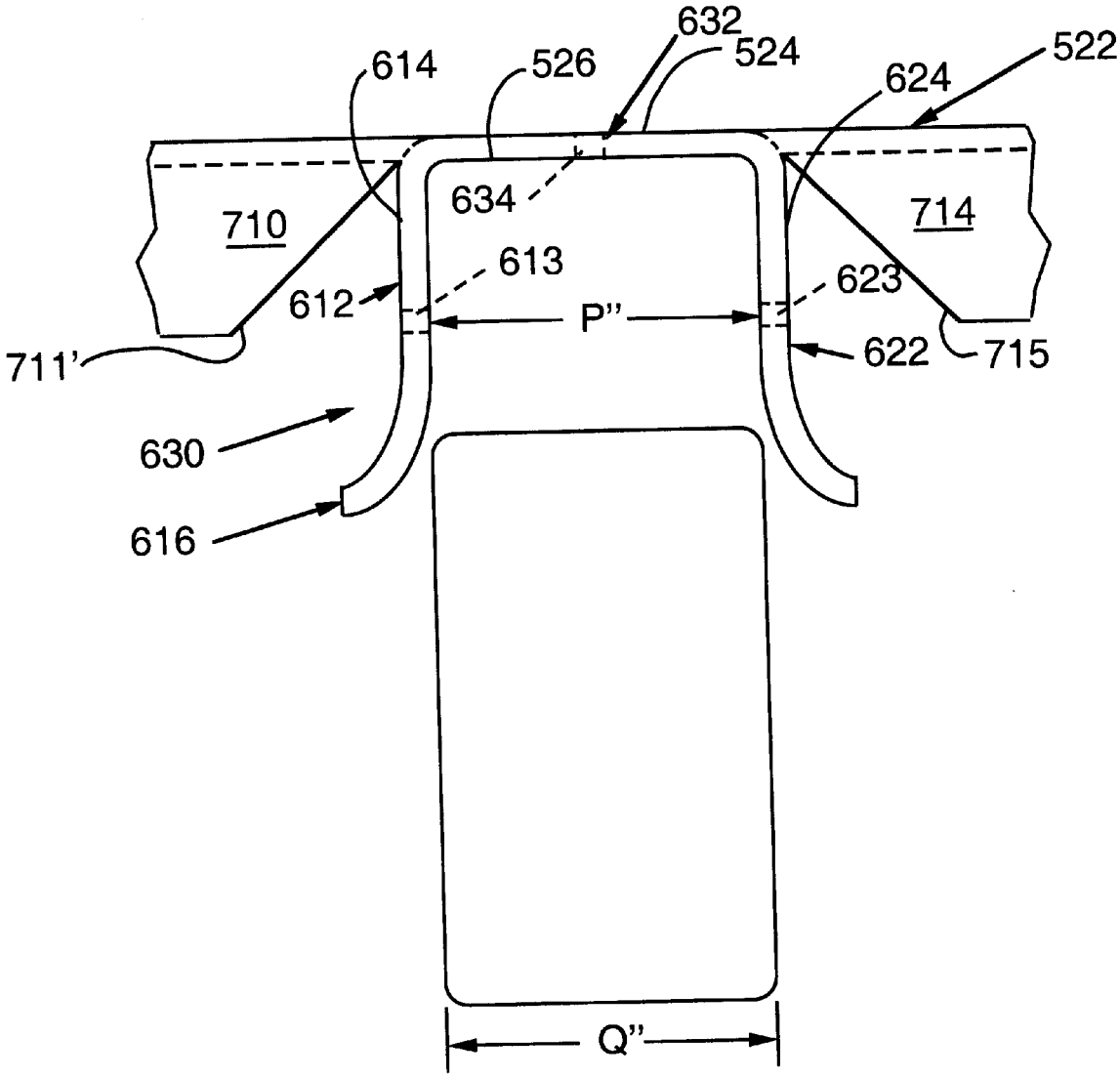
FIG. 38 is partial front elevational view of the third pair of clamping tabs of the spacer bar of FIGS. 29–37 prior to installation on the upper chord of a roof truss.
Figure 38A:
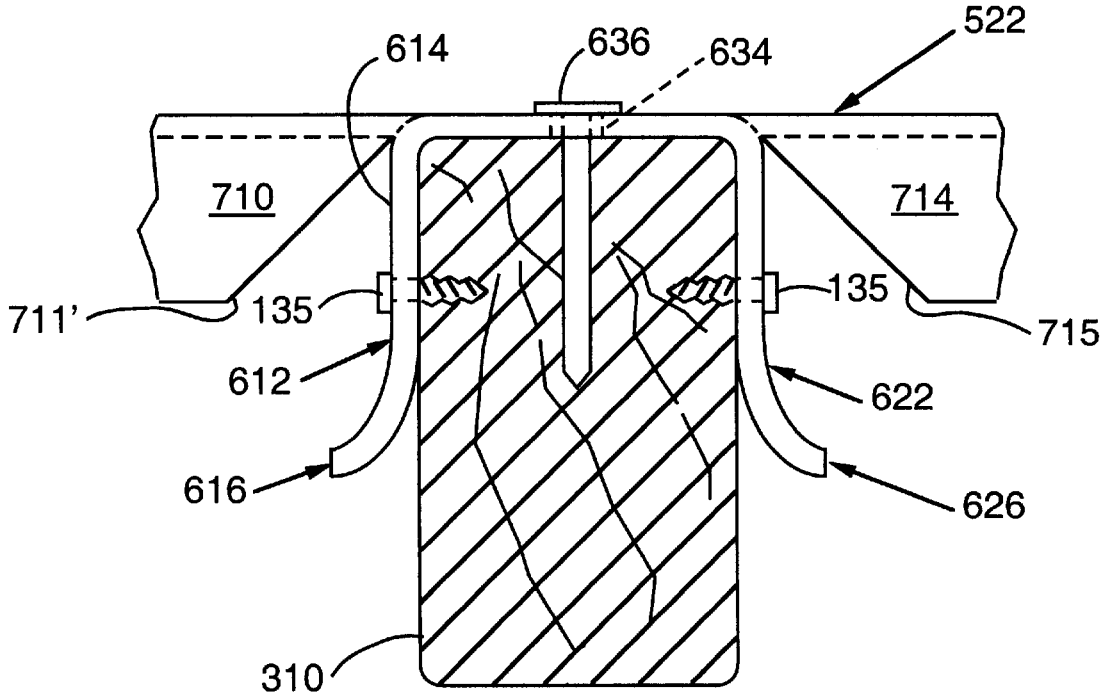
FIG. 38A is another partial front elevational view of the third pair of clamping tabs installed on the upper chord of the roof truss depicted in FIG. 38.

As can be seen in FIG. 38, a third planar portion 632 of the planar brace member 522 extends between the tabs (612, 622). One or more third fastener openings 634 may be provided through the third planar portion 632 to enable conventional third fasteners 636 (i.e., nails, screws, etc.) to be inserted therethrough to fasten the spacer bar 520 to a building component such as roof truss 310 in the manners discussed above.

The reader will further appreciate that the tabs (532, 542, 562, 572, 612, 622) are substantially rigid with respect to the planar brace member 522. However, if the spacer bar 520 is fabricated from the above-identified material, such material enables the tabs to flex slightly when the truss component is inserted therebetween. For example, during installation, the tabs (532, 542) may each flex outward in the manner described above. Thus, the term "rigid" as used herein with respect to tabs (532, 542, 562, 572, 612, 622), means that such tabs cannot be repositioned longitudinally along the brace member 522 but rather remain affixed thereto while permitting their respective lower portions to flex slightly for installation purposes. That term also encompasses tabs that do not flex and are unable to be repositioned longitudinally along the brace member 522.

To provide the spacer bar 520 with axial rigidity between in the first pair of clamping tabs 550 and the second pair of clamping tabs 580, a first reinforcing member 590 may be centrally disposed in a portion 525 of the elongated planar brace member 522 that extends between the second tab 542 and the third tab 562. In this embodiment, the first reinforcing ember 590 comprises a first reinforcing rib segment 592 that is integrally formed in the portion 525 and is essentially identical to reinforcing rib segment 92 as described above. More particularly and with reference to FIGS. 31 and 32, the first reinforcing rib segment 592 may comprise an arcuate rib that is centrally disposed in the portion 525. For example, in an embodiment wherein distance G" is 22½ inches, the first reinforcing rib segment 92 may be 21 inches long. In an embodiment wherein the elongated planar brace member 522 is 3.5 inches wide, the first reinforcing rib segment 592 may be 1.5 inches wide and be ¾ inches deep. The rib segment 592 may be formed with radiused edges with respect to the planar upper surface 524 of the brace member 522. Those of ordinary skill in the art will appreciate, however, that other shapes and sizes of reinforcing members may be formed in or attached to the planar brace member 522 to provided additional rigidity thereto without departing from the spirit and scope of the present invention.

Similarly, to provide the spacer bar 520 with axial rigidity between in the second pair of clamping tabs 80 and the third pair of clamping tabs 630, a second reinforcing member 640 may be centrally disposed in a portion 642 of the elongated planar brace member 522 that extends between the fourth tab 572 and the fifth tab 612. In this embodiment, the second reinforcing member 640 comprises a second reinforcing rib segment 644 that is integrally formed in the portion 642 and is sized similarly to the reinforcing rib 144 as described above. Those of ordinary skill in the art will appreciate, however, that other shapes and sizes of reinforcing members may be formed in or attached to the planar brace member 522 to provide additional rigidity thereto without departing from the spirit and scope of the present invention.

The reader will appreciate that the spacer bar 520, up to this point, is essentially identical to the spacer bar 20 as described above. However, as can be seen in FIGS. 29–35, in this embodiment, the spacer bar 520 is provided with downwardly extending lateral sides that serve to further strengthen the spacer bar 520.

Figure 29:
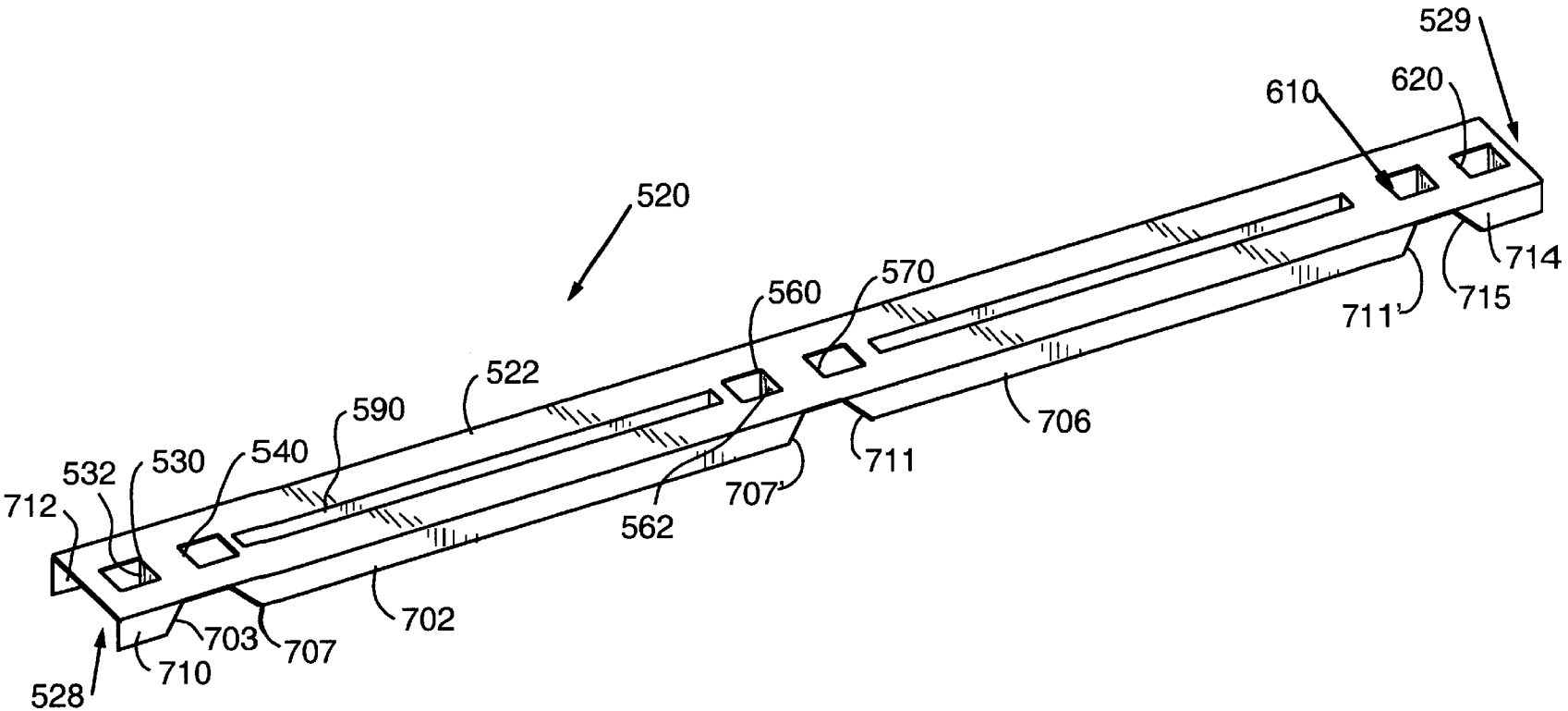
FIG. 29 is a perspective view of another spacer bar of the present invention.
Figure 31:
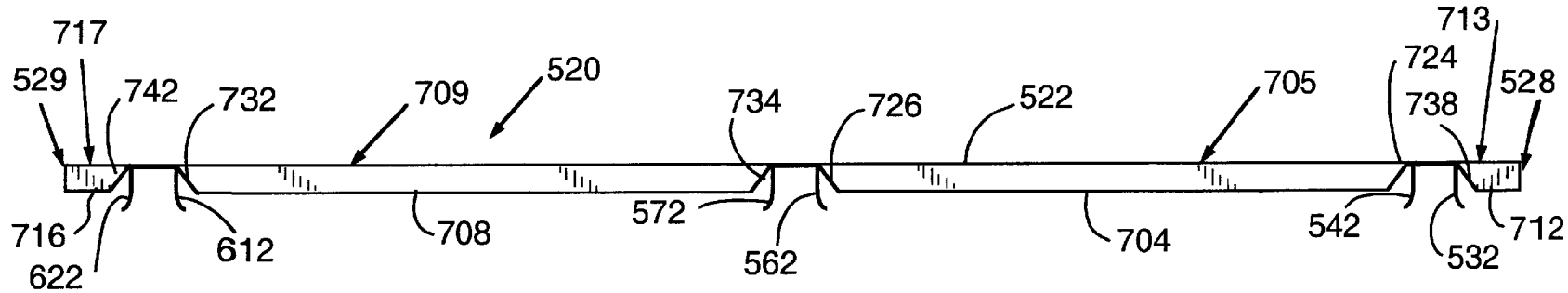
FIG. 31 is a rear elevational view of the spacer bar of FIGS. 29 and 30.
Figure 32:
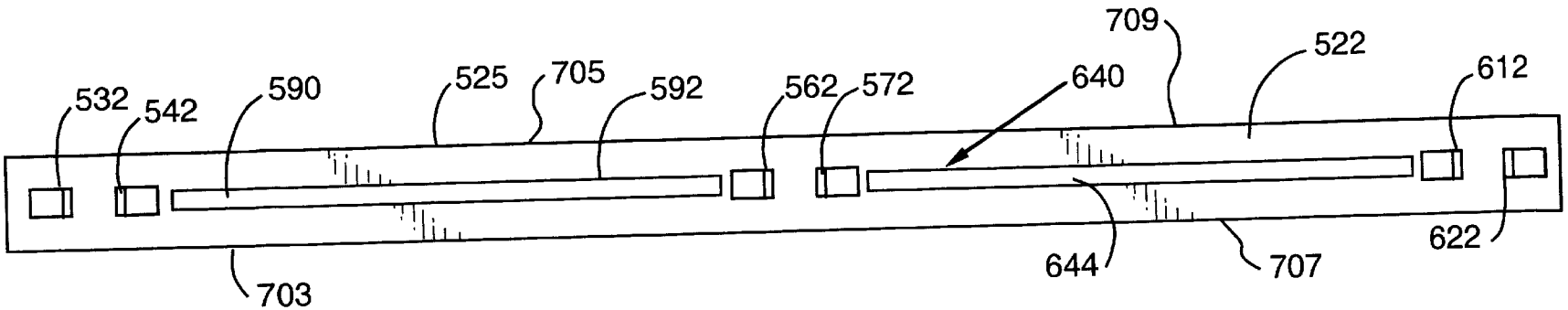
FIG. 32 is a top view of the spacer bar of FIGS. 29–31.
Figure 33:
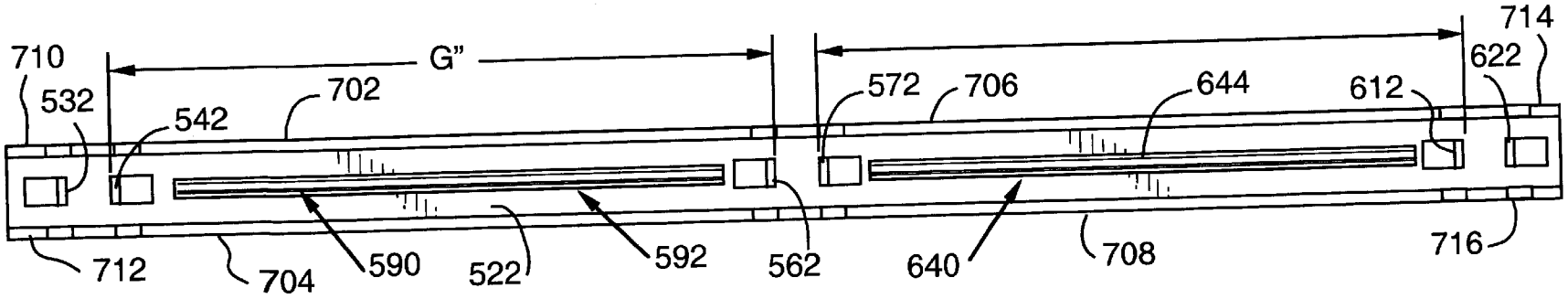
FIG. 33 is a bottom view of the spacer bar of FIGS. 29–32.
Figure 34:
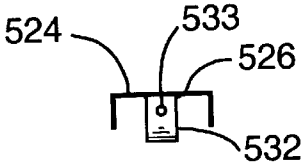
FIG. 34 is a left side elevational view of the spacer bar of FIGS. 29–33.
Figure 35:
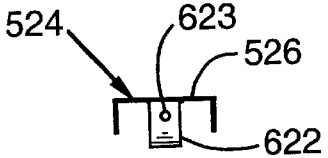
FIG. 35 is a right side elevational view of the spacer bar of FIGS. 29–34.

More particularly and with reference to FIGS. 29–31, a first lateral side member 702 extends perpendicularly downward from a first lateral side portion 703 of brace 522 and extends between the second tab 542 and the third tab 562. A second lateral side member 704 extends perpendicularly downward from a second lateral side portion 705 of the brace 522 and extends between the second tab 542 and the third tab 562. See FIG. 31. In addition, a third lateral side member 706 extends perpendicularly downward from a third lateral side portion 707 of brace 522 and extends between the fourth tab 572 and the fifth tab 612. A fourth lateral side member 708 extends perpendicularly downward from a fourth lateral side portion 709 of the brace member 522 and extends between the fourth tab 572 and the fifth tab 612. The planar brace member 522 has a first end 528 and second end 529. A fifth lateral side member 710 extends perpendicularly downward from the brace member 522 along a fifth lateral side portion 711 and extends between the first end 528 and the first tab 532. A sixth lateral side member 712 extends perpendicularly downward from a sixth lateral side portion 713 of the brace member 522 and extends between the first end 528 and the first tab 532. A seventh lateral side member 714 extends perpendicularly downward from a seventh lateral side portion 715 of the brace member 522 and extends between the second end 529 and the sixth tab 622. An eighth lateral side member 716 extends perpendicularly downward from an eighth lateral side portion of 717 the brace member 522 and extends between the second end 529 and the eighth tab 622. In this embodiment, the lateral side members are integrally formed from the brace member 522 and may protrude downward from the lower surface 526 of the brace member 522 approximately one inch. However, the length of lateral side members may vary depending upon the application.

As can also be seen in FIGS. 30 and 31, in this embodiment, lateral side 702 has an angled or clipped portion 720 adjacent tab 542. Also in this embodiment, lateral side 702 has a clipped or angled portion 722 that is adjacent the tab 562. Also in this embodiment, lateral side 704 has a clipped portion 724 adjacent tab 532 and another clipped portion 726 adjacent tab 562. Likewise, lateral side 706 has a clipped portion 728 adjacent tab 572 and another clipped portion 730 adjacent tab 612. Also in this embodiment, lateral side 708 has a clipped or angled portion 732 adjacent tab 612 and another clipped or angled portion 734 adjacent tab 572. Likewise, lateral side 710 has a clipped or angled portion 736 adjacent tab 532. Also in this embodiment, lateral side 712 has a clipped or angled portion 738 adjacent tab 532 and lateral side 714 has a clipped or angled portion 740 adjacent tab 622. Lateral side 716 has a clipped or angled portion 742 adjacent tab 622. In one embodiment, the angled or clipped portions are at approximately 450 with respect to the lower surface 526 of the brace member 522 (Angle "Z" in FIG. 36). However, other angle arrangements could be employed. While the lateral sides (702, 704, 706, 708, 710, 712, 714, 716) have been described above as being integrally formed from the brace 522, those of ordinary skill in the art will appreciate that the lateral sides could conceivably be fabricated from separate components and otherwise fastened (i.e., welded, etc.) to the brace 522.

Figure 39:
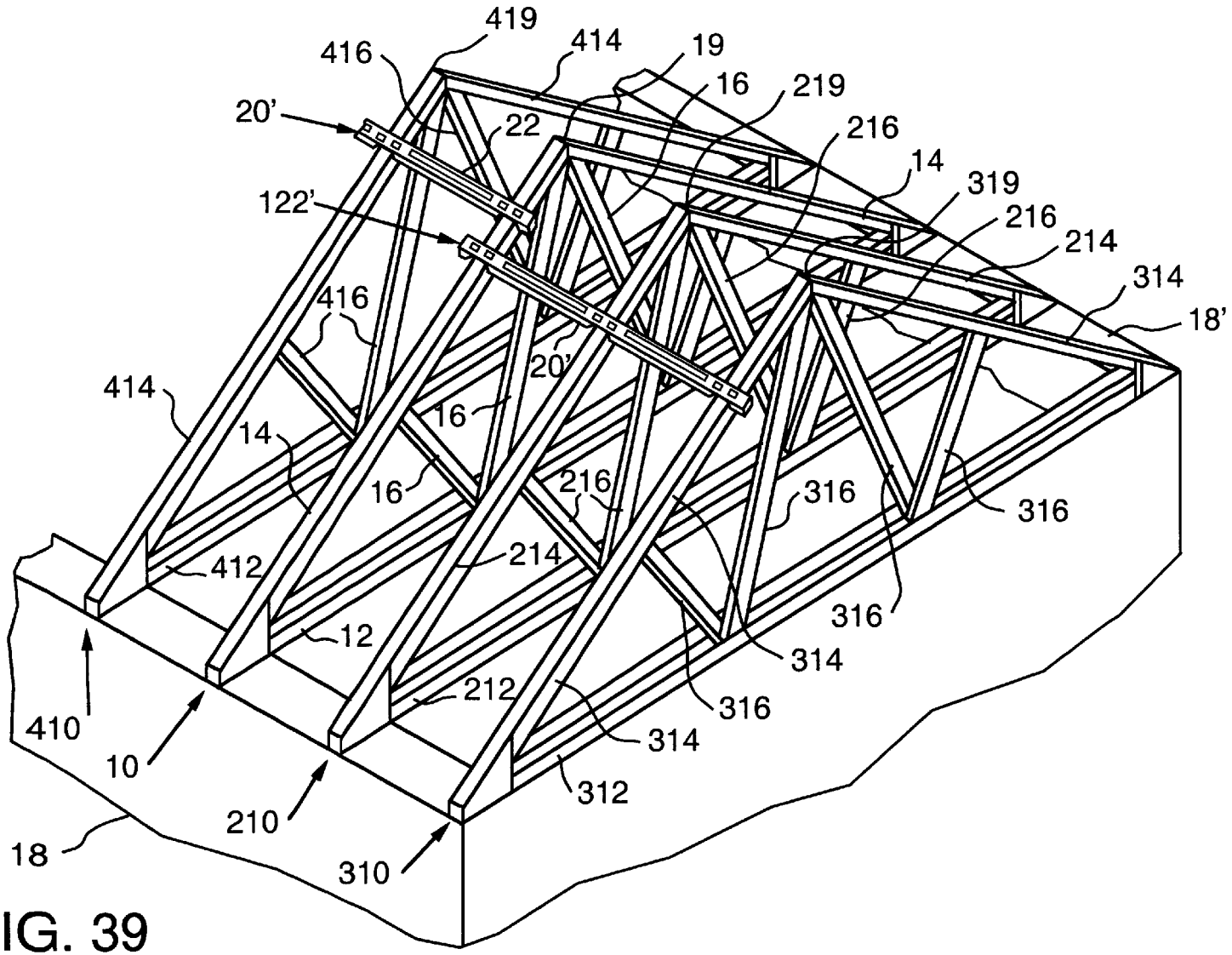
FIG. 39 is perspective view of two spacer bars depicted in FIGS. 29–38 supporting a plurality of roof trusses on support walls.

The spacer bar 520 is installed in the manner described above with respect to spacer bar 20. FIG. 39 depicts the spacer bars 520 employed to support a number of trusses in the manner described above.

Figure 40:
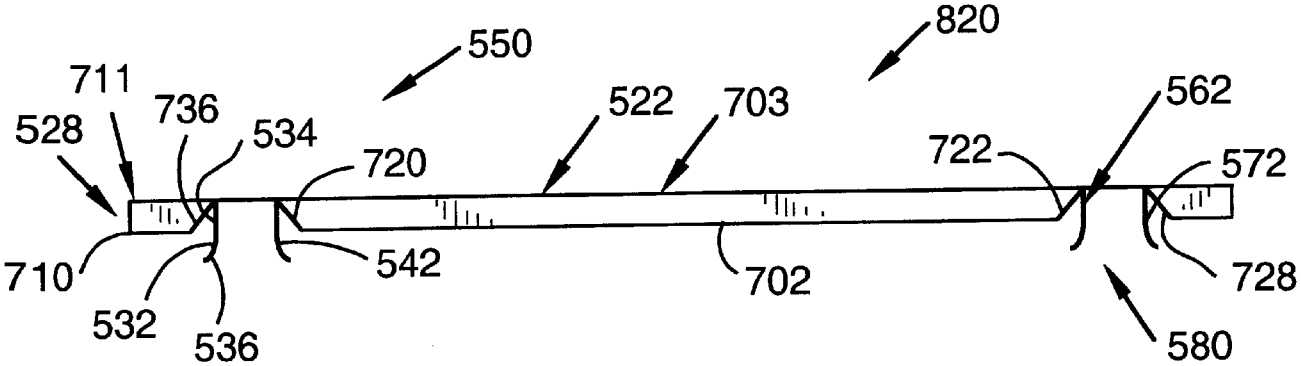
FIG. 40 is a front elevational view of another embodiment of the spacer bar of the present invention.
Figure 41:
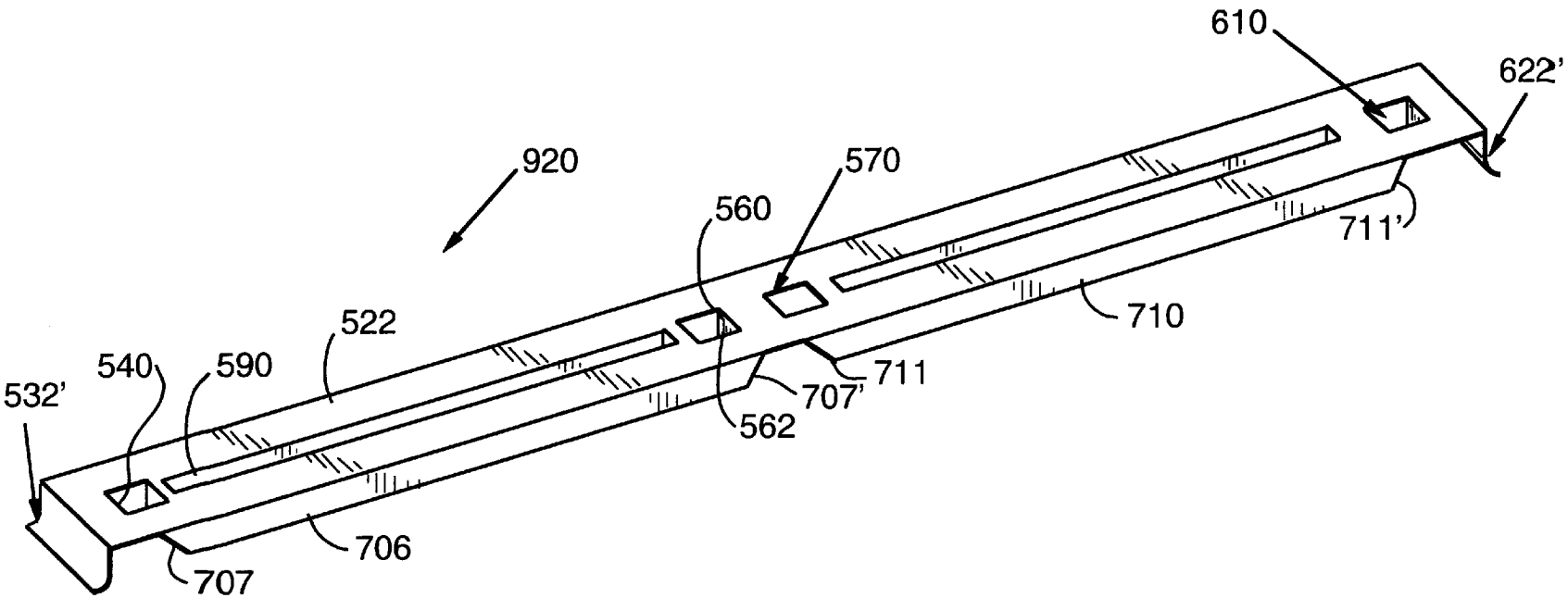
FIG. 41 is a perspective view of another spacer bar of the present invention.
Figure 42:
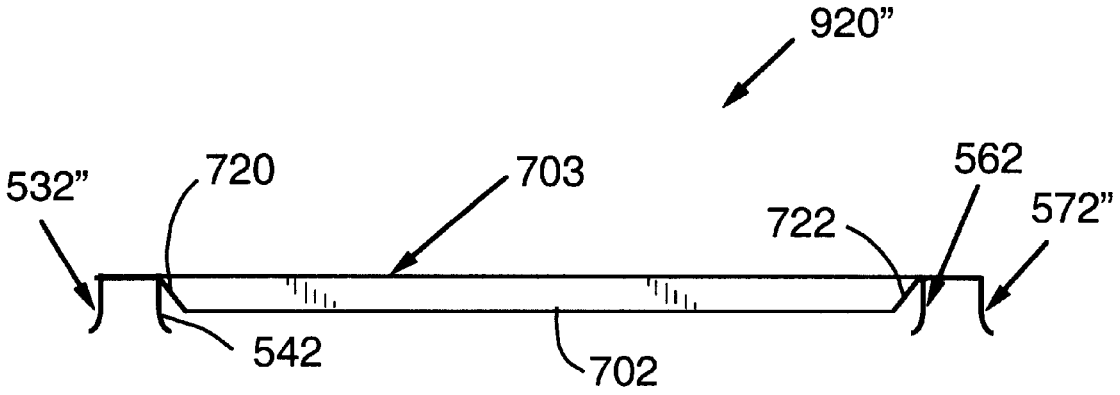
FIG. 42 is a front elevational view of another spacer bar of the present invention.

FIG. 40 also depicts a spacer bar 820 that is adapted to support only two building components or trusses. The reader will appreciate that the spacer bar 820 is identical in construction as spacer bar 520, except that it only has two sets of clamping tabs (550, 580). FIG. 41 illustrates another embodiment of the spacer bar of the present invention designated as 920 that is constructed like the spacer bar depicted in FIG. 29, except that the brace member 522 does not extend beyond the end tabs 532' and 622'. FIG. 42 depicts a spacer bar 920' that is constructed like the spacer bar depicted in FIG. 40 except that the brace member 522 does not extend beyond the end tabs 532 and 572.

Figure 43:
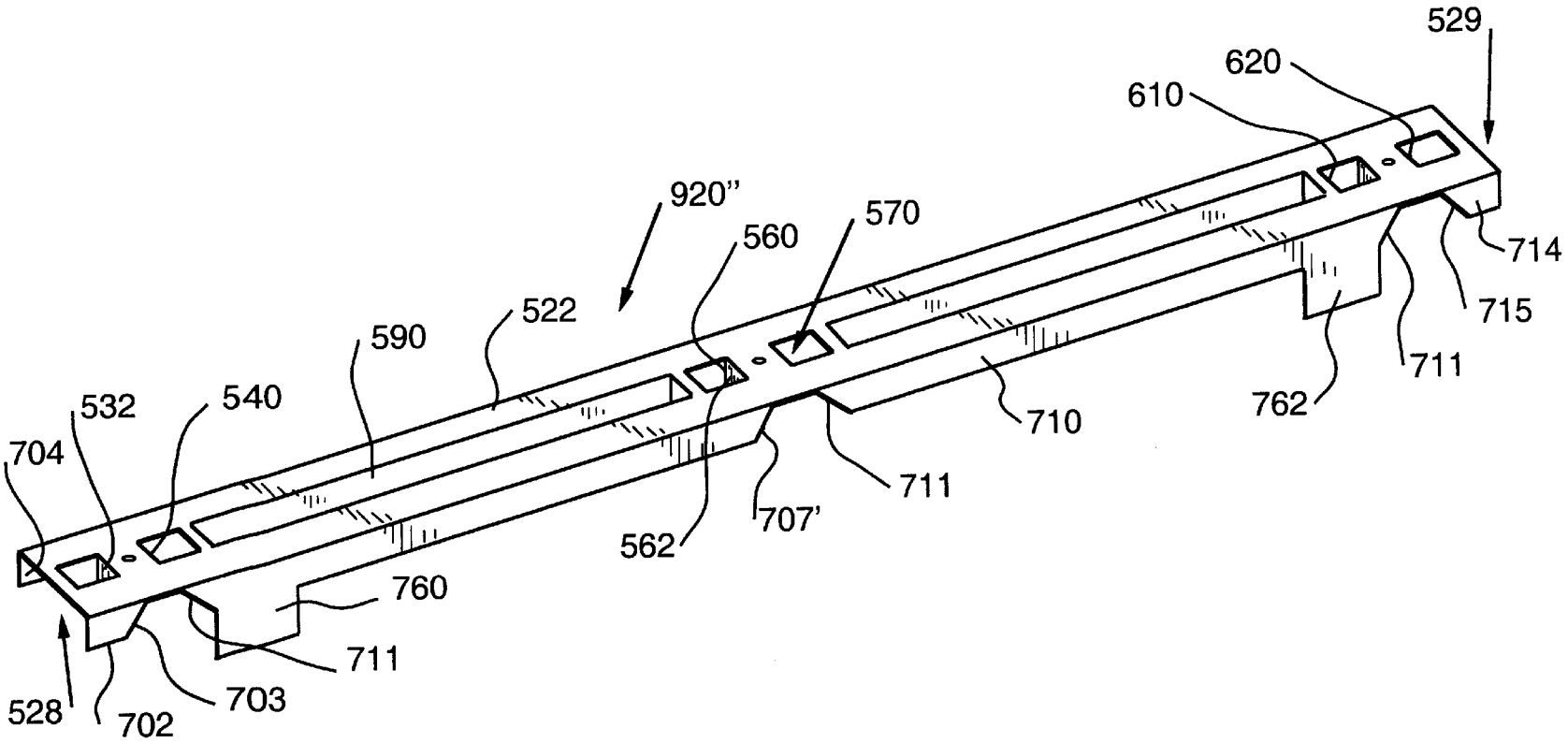
FIG. 43 is a perspective view of another spacer bar of the present invention.
Figure 44:
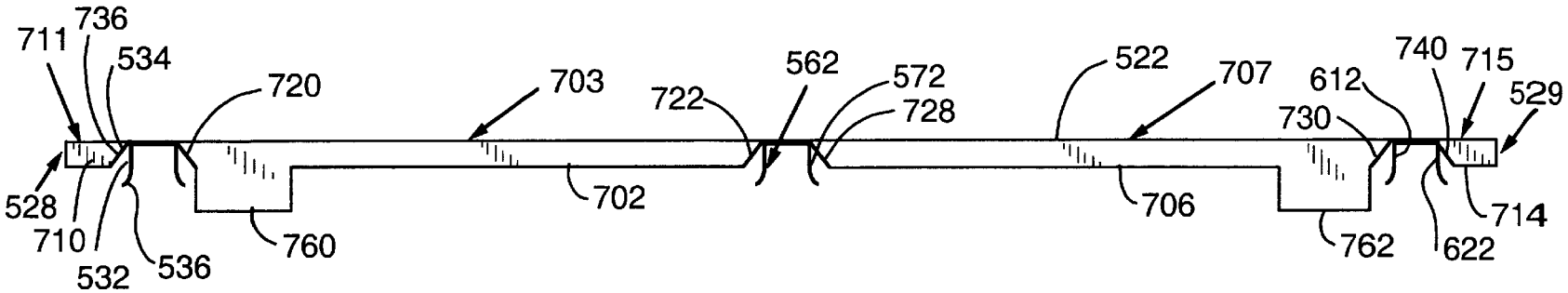
FIG. 44 is a front elevational view of the spacer bar of FIG. 43.
Figure 45:
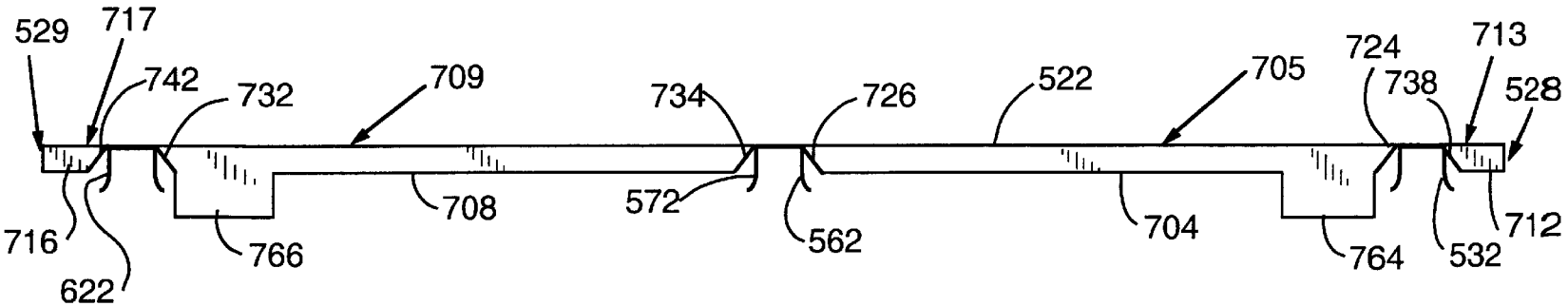
FIG. 45 is a rear elevational view of the spacer bar of FIGS. 43 and 44.
Figure 46:
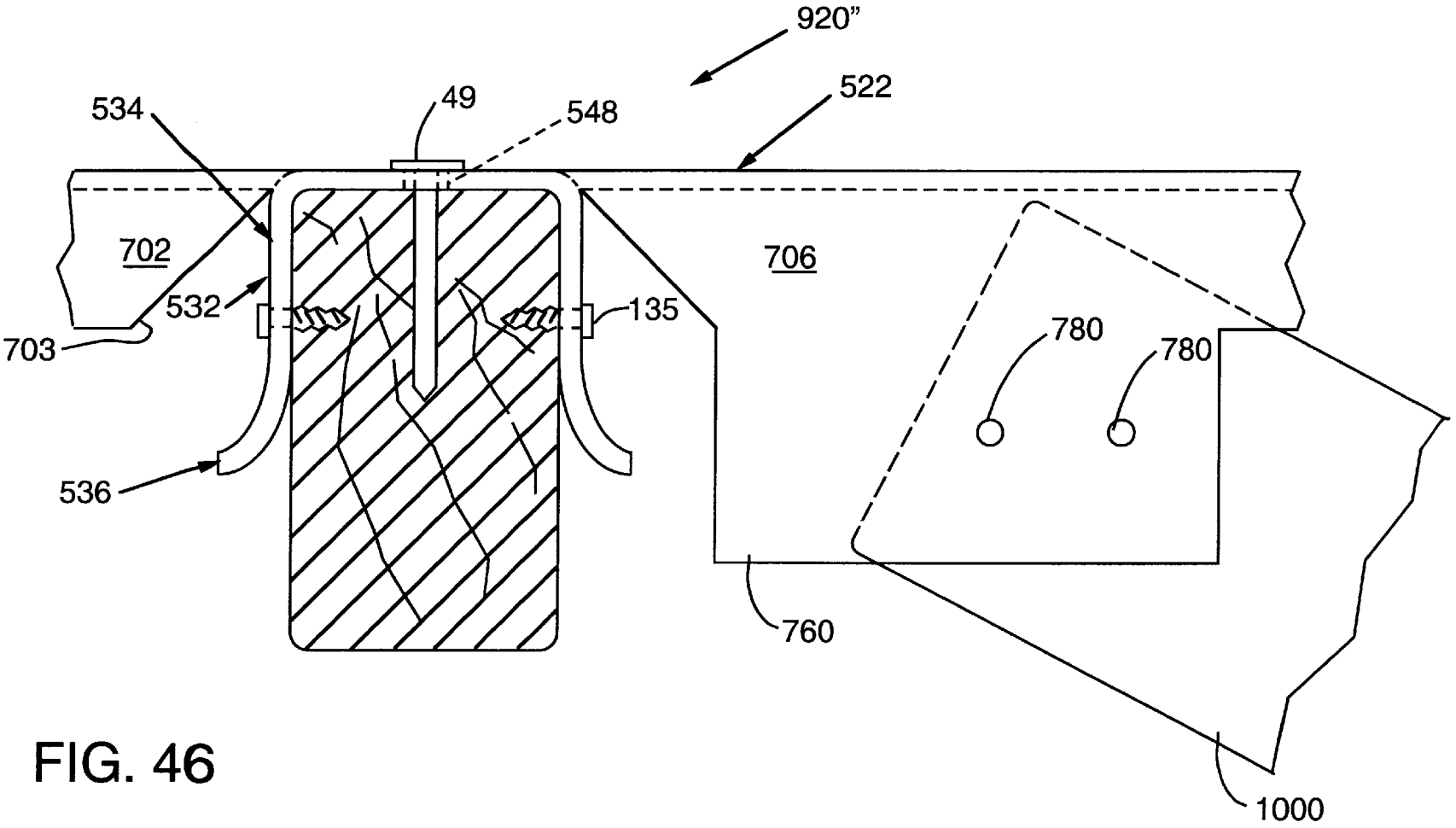
FIG. 46 is a partial view of the spacer bar of FIGS. 43–45 attached to a truss and a diagonal support brace.
Figure 47:
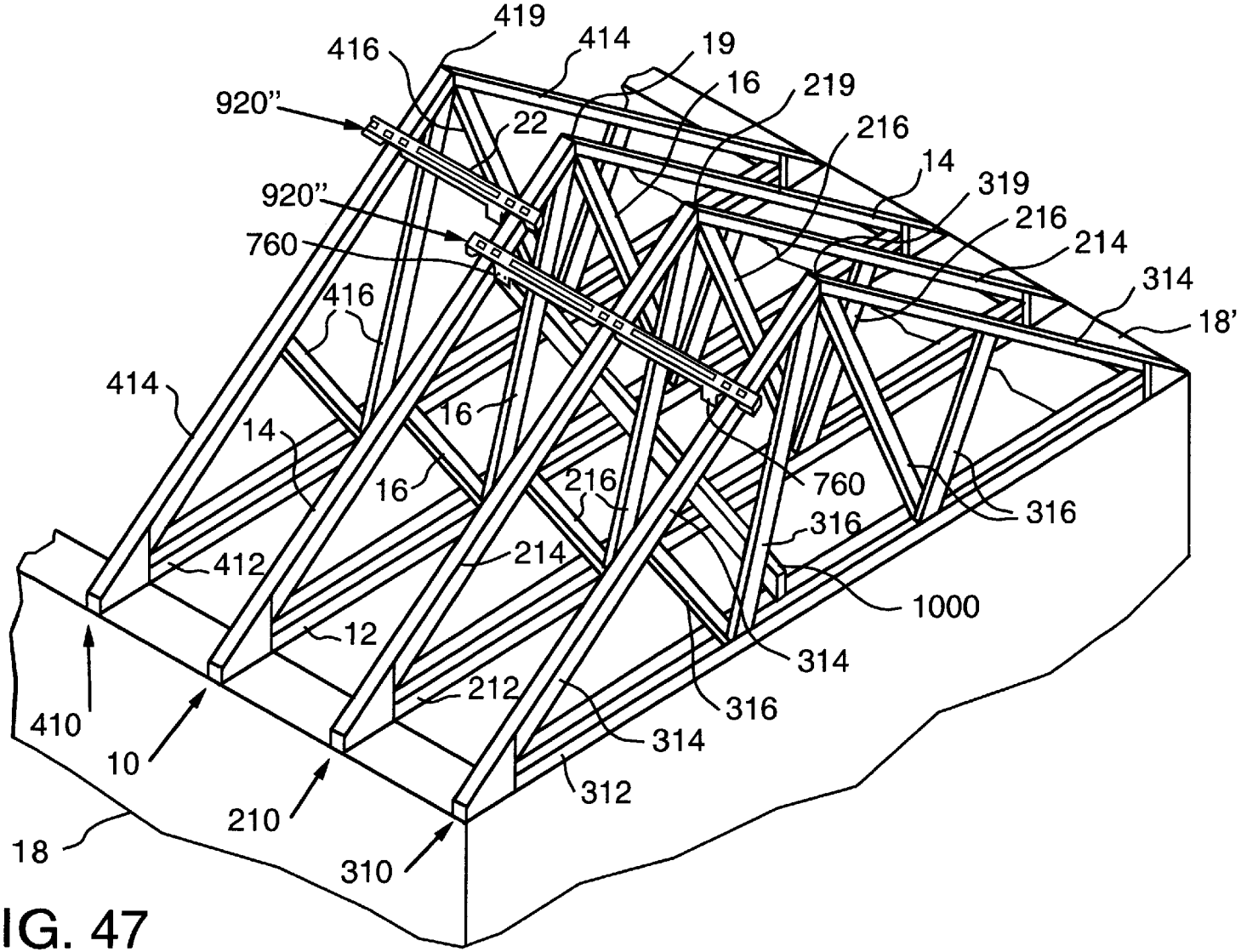
FIG. 47 is a perspective view of two spacer bars of FIGS. 43–46 supporting a plurality of roof trusses on support walls.

FIGS. 43–47 illustrate yet another embodiment of the present invention. FIGS. 43–45 illustrate a spacer bar 920" that is identical to spacer bar 520 as described above except that spacer bar 920" includes additional attachment tab portions (760, 762, 764, 766) that protrude from a portion of a corresponding lateral side to enable a diagonal truss brace 1000 to be attached thereto. As can be seen in FIG. 46, one end of the truss brace 1000 is attached to the attachment tab portion 760 and the bottom chord of another truss (i.e., 312) by appropriate fasteners 780 such as nails, screws, etc. The reader will appreciate that such arrangement can further prevent the trusses from topping over during installation and provide further stability to the trusses. The reader will also appreciate that the spacer bar 920" may be constructed to accommodate two trusses, three trusses (as shown in FIGS. 43–47) or more than three trusses without departing from the sprit and scope of the present invention.

Thus, from the foregoing discussion, it is apparent that the present invention solves many of the problems encountered by prior truss spacer devices. In particular, the spacer bars of the present invention are relatively easy to manufacture and install. Because of their clamping action, they rigidly retain the trusses or other building components in a desired upright and spaced-apart relationship while additional trusses and fasteners are installed. It is believe that additional trusses may be installed in the above-described manner prior to affixing the spacer bars to the trusses with fasteners such as nails, screws, etc. without the risk of the trusses toppling over. In addition, the present spacer bars do not have to be removed from the trusses before installing appropriate decking materials to the trusses. Those of ordinary skill in the art will, of course, appreciate that various changes in the details, materials and arrangement of parts which have been herein described and illustrated in order to explain the nature of the invention may be made by the skilled artisan within the principle and scope of the invention as expressed in the appended claims.

What is claimed is:

1. A spacer bar, comprising:

an elongated planar brace member having a planar upper surface and a planar lower surface;

a first tab perpendicularly protruding from said planar lower surface of said elongated planar brace member and having a first flared lower portion;

a second tab perpendicularly protruding from said lower surface of said elongated planar brace member spaced from said first tab a first fixed predetermined distance;

a third tab perpendicularly protruding from said lower surface of said elongated planar brace member spaced from said second tab a second predetermined distance; and a fourth tab perpendicularly protruding from said lower surface of said elongated planar brace member spaced from said third tab a third fixed predetermined distance, at least one of said third and fourth tabs having a flared lower portion.

2. The spacer bar of claim 1 wherein said second tab has a second flared lower portion and wherein said third tab has a third flared portion and said fourth tab has a fourth flared lower portion.

3. The spacer bar of claim 2 wherein said first predetermined distance is greater than a first cross sectional distance of a first structural member and wherein said third predetermined distance is greater than a second cross-sectional thickness of a second structural member.

4. The spacer bar of claim 2 further comprising a first reinforcing member centrally disposed in a portion of said elongated planar brace member extending between said second tab and said third tab.

5. The spacer bar of claim 4 wherein said reinforcing member comprises a first reinforcing rib segment integrally formed in said portion of said elongated brace member extending between said second tab and said third tab.

6. The spacer bar of claim 1 wherein said first predetermined distance is substantially equal to a first cross sectional distance of a first structural member and wherein said third predetermined distance is substantially equal to a second cross-sectional thickness of a second structural member.

7. The spacer bar of claim 1 wherein said first predetermined distance is greater than a first cross sectional distance of a first structural member and wherein said third predetermined distance is greater than a second cross-sectional thickness of a second structural member.

8. The spacer bar of claim 1 wherein at least one of said first, second, third, and fourth tabs are integrally formed with said elongated planar brace member.

9. The spacer bar of claim 1 further comprising a first reinforcing member centrally disposed in a portion of said elongated planar brace member extending between said second tab and said third tab.

10. The spacer bar of claim 9 wherein said reinforcing member comprises a first reinforcing rib segment integrally formed in said portion of said elongated brace member extending between said second tab and said third tab.

11. The spacer bar of claim 1 further comprising a fifth tab perpendicularly protruding from said lower planar surface of said elongated planar brace member a fourth predetermined distance from said fourth tab; and a sixth tab perpendicularly protruding from said lower planar surface of said elongated planar brace member a fifth predetermined distance from said fifth tab.

12. The spacer bar of claim 11 wherein at least one of said fifth and sixth tabs has a lower flared portion.

13. The spacer bar of claim 12 wherein said fifth tab has a fifth lower flared portion and said sixth tab has a sixth flared lower portion.

14. The spacer bar of claim 13 wherein said fifth predetermined distance is substantially equal to a cross-sectional thickness of a third structural member.

15. The spacer bar of claim 11 wherein said first, second third, fourth, fifth and sixth tabs are integrally formed with said planar brace member.

16. The spacer bar of claim 11 wherein said first, second, third, fourth, fifth and sixth tabs each have at least one fastener opening extending therethrough.

17. The spacer bar of claim 11 wherein said first predetermined distance is substantially equal to a first cross sectional distance of a first structural member and wherein said fourth predetermined distance is substantially equal to a second cross-sectional thickness of a second structural member.

18. The spacer bar of claim 17 wherein said fifth predetermined distance is greater than a cross-sectional thickness of a third structural member.

19. A spacer bar, comprising:

an elongated planar brace member having a planar upper surface and a planar lower surface and a first end and a second end;

a first tab perpendicularly protruding from said planar lower surface of said elongated planar brace member;

a second tab perpendicularly protruding from said lower surface of said elongated planar brace member spaced from said first tab a first fixed predetermined distance;

a third tab perpendicularly protruding from said lower surface of said elongated planar brace member spaced from said second tab a second predetermined distance;

a fourth tab perpendicularly protruding from said lower surface of said elongated planar brace member spaced from said third tab a third fixed predetermined distance;

a first lateral side member protruding downward from a first lateral side portion of said planar brace member between said second tab and said third tab;

a second lateral side member protruding downward from a second lateral side portion of said planar brace member between said second tab and said third tab;

a third lateral side member protruding downward from a third lateral side portion of said planar brace member between said first end and said first tab; and a fourth lateral side member protruding downward from a fourth lateral side portion of said planar brace member between said first end and said first tab.

20. The spacer bar of claim 19 wherein said first tab is located at said first end of said elongated planar brace.

21. The spacer bar of claim 19 further comprising:

a fifth lateral side member protruding downward from a fifth lateral side portion of said planar brace member between said second end and said fourth tab; and a sixth lateral side member protruding downward from a sixth lateral side portion of said planar brace member between said second end and said fourth tab.

22. The spacer bar of claim 19 wherein said fourth tab is located at said second end of said elongated planar brace member.

23. The spacer bar of claim 19 wherein said first tab is located at said first end of said elongated planar brace member and wherein said second tab is located at said second end of said elongated planar brace member.

24. The spacer bar of claim 19 further comprising a first reinforcing member centrally disposed in a portion of said elongated planar brace member extending between said second tab and said third tab.

25. The spacer bar of claim 24 wherein said reinforcing member comprises a first reinforcing rib segment integrally formed in said portion of said elongated brace member extending between said second tab and said third tab.

26. The spacer bar of claim 19 wherein a portion of said first lateral side member adjacent said second tab has an angled portion and wherein a portion of said first lateral side member adjacent said third tab has another angled portion and wherein a portion of said second lateral side member has an angled portion adjacent said second tab and wherein said second lateral side has another angled portion adjacent said third tab member.

27. The spacer bar of claim 26 wherein said third lateral side member has an angled portion adjacent said first tab and wherein said fourth lateral side member has another angled portion adjacent said first tab member.

28. The spacer bar of claim 27 wherein said fifth lateral side member has an angled portion adjacent said fourth tab and wherein said sixth lateral side member has an angled portion adjacent said fourth tab member.

29. The spacer bar of claim 19 wherein said first, second third and fourth tabs each have a flared lower portion.

30. A spacer bar, comprising:

an elongated planar brace member having a planar upper surface and a planar lower surface and a first end and a second end;

a first tab perpendicularly protruding from said planar lower surface of said elongated planar brace member and having a first flared lower portion;

a second tab perpendicularly protruding from said lower surface of said elongated planar brace member spaced from said first tab a first fixed predetermined distance;

a third tab perpendicularly protruding from said lower surface of said elongated planar brace member spaced from said second tab a second predetermined distance;

a fourth tab perpendicularly protruding from said lower surface of said elongated planar brace member spaced from said third tab a third fixed predetermined distance, at least one of said third and fourth tabs having a flared lower portion;

a fifth tab perpendicularly protruding from said lower surface of said elongated planar brace member spaced from said fourth tab a fourth predetermined distance;

a sixth tab perpendicularly protruding from said lower surface of said elongated planar brace member spaced from said fifth tab a fifth predetermined distance;

a first lateral side member protruding downward from a first lateral side portion of said planar brace member between said second tab and said third tab;

a second lateral side member protruding downward from a second lateral side portion of said planar brace member between said second tab and said third tab;

a third lateral side member protruding downward from a third lateral side portion of said planar brace member between said fourth tab and fifth tab; and a fourth lateral side member protruding downward from a fourth lateral side portion of said planar brace member between said fourth tab and said fifth tab.

31. The spacer bar of claim 30 further comprising:

a fifth lateral side member protruding downward from a fifth lateral side portion of said planar brace member between said first end and said first tab; and a sixth lateral side member protruding downward from a sixth lateral side portion of said planar brace member between said first end and said first tab.

32. The spacer bar of claim 31 further comprising:

a seventh lateral side member protruding downward from a seventh lateral side portion of said planar brace member between said second end and said sixth tab; and an eighth lateral side member protruding downward from a eighth lateral side portion of said planar brace member between said second end and said sixth tab.

33. The spacer bar of claim 30 wherein said first tab is adjacent said first end of said planar brace member.

34. The spacer bar of claim 30 wherein said sixth tab is adjacent said second end of said planar brace member.

35. The spacer bar of claim 30 further comprising a first reinforcing member centrally disposed in a portion of said elongated planar brace member extending between said second tab and said third tab.

36. The spacer bar of claim 35 wherein said reinforcing member comprises a first reinforcing rib segment integrally formed in said portion of said elongated brace member extending between said second tab and said third tab.

37. A spacer bar, comprising:

an elongated planar brace member having a planar upper surface and a planar lower surface;

a first portion punched from said elongated planar brace member and bent substantially perpendicular to said lower planar surface to form a first tab;

a second portion punched from said elongated planar brace member and bent substantially perpendicular to said lower planar surface to form a second tab spaced from said first tab such that a first planar portion of said planar brace member extends therebetween;

a third portion punched from said elongated planar brace member and bent substantially perpendicular to said lower planar surface to form a third tab spaced from said second tab; and a fourth portion punched from said elongated planar brace member and bent substantially perpendicular to said lower planar surface to form a fourth tab spaced from said third tab to define a second planar portion of said elongated brace member therebetween and wherein at least one of said first tab and said second tab have a flared lower portion and wherein at least one of said third and fourth tabs have a lower flared portion.

38. The spacer bar of claim 37 wherein said first tab has a first flared lower portion, said second tab has a second flared lower portion, said third tab has a third flared lower potion and said fourth tab has a fourth lower flared portion.

39. The spacer bar of claim 37 wherein said first tab is spaced from said second tab a first predetermined distance that is substantially equal to a cross-sectional thickness of a first structural member.

40. The spacer bar of claim 39 wherein said third tab is spaced a third predetermined distance from said fourth tab that is substantially equal to a cross-sectional thickness of a second structural member.

41. The spacer bar of claim 37 wherein said first tab is spaced from said second tab a first predetermined distance that is less than a cross-sectional thickness of a first structural member.

42. The spacer bar of claim 41 wherein said third tab is spaced a third predetermined distance from said fourth tab that is less than a cross-sectional thickness of a second structural member.

43. The spacer bar of claim 37 further comprising a first reinforcing member centrally disposed in a portion of said elongated planar brace member extending between said second tab and said third tab.

44. The spacer bar of claim 43 wherein said reinforcing member comprises a first reinforcing rib segment integrally formed in said portion of said elongated planar brace member extending between said second tab and said third tab.

45. The spacer bar of claim 37 further comprising at least one fastener opening in said first planar portion of said elongated brace member and at least one fastener opening in said second planar portion.

46. The spacer bar of claim 37 further comprising:

a fifth portion punched from said elongated planar brace member and bent substantially perpendicular to said lower planar surface to form a fifth tab spaced from said fourth tab; and a sixth portion punched from said elongated planar brace member and bent substantially perpendicular to said lower planar surface to form a sixth tab spaced from said fifth tab to define a third planar portion of said elongated brace member therebetween.

47. The spacer bar of claim 46 wherein at least one of said first tab and said second tab have an flared lower portion and wherein at least one of said third and fourth tabs have a lower flared portion and wherein at least one of said fifth and sixth tabs have a lower flared portion.

48. The spacer bar of claim 47 wherein said first tab has a first flared lower portion, said second tab has a second flared lower portion, said third tab has a third flared lower potion, said fourth tab has a fourth flared lower portion, said fifth tab has a fifth flared lower portion and said sixth tab has a sixth flared lower portion.

49. The spacer bar of claim 48 wherein said sixth tab is spaced from said fifth tab a fourth predetermined distance that is substantially equal to a cross-sectional thickness of a third structural member.

50. The spacer bar of claim 49 wherein said sixth tab is spaced a fourth predetermined distance from said fifth tab that is less than a cross-sectional thickness of a first structural member.

51. The spacer bar of claim 46 further comprising a first reinforcing member centrally disposed in a portion of said elongated planar brace member extending between said second tab and said third tab and a second reinforcing member centrally disposed in another portion of said elongated planar brace member extending between said fourth tab and said fifth tab.

52. The spacer bar of claim 51 wherein said first reinforcing member comprises a first reinforcing rib segment integrally formed in said portion of said elongated planar brace member extending between said second tab and said another tab and wherein said second reinforcing member comprises a second reinforcing rib segment integrally formed in said third portion of said elongated planar brace member extending between said fourth tab and said fifth tab.

53. A spacer bar for supporting a first truss member, a second truss member and a third truss member, said spacer bar comprising:

an elongated planar brace member having a planar upper surface and a planar lower surface;

a first portion punched from said elongated planar brace member and bent substantially perpendicular to said lower planar surface to form a first tab, said first tab having a first flared lower portion;

a second portion punched from said elongated planar brace member and bent substantially perpendicular to said lower planar surface to form a second tab spaced a second predetermined distance from said first tab, said second tab having an flared lower portion;

a third portion punched from said elongated planar brace member and bent substantially perpendicular to said lower planar surface to form a third tab spaced from said second tab, said third tab having a third flared lower portion;

a fourth portion punched from said elongated planar brace member and bent substantially perpendicular to said lower planar surface to form a fourth tab spaced from said third tab to define a second planar portion of said elongated brace member therebetween, said fourth tab having a fourth flared lower portion;

a fifth portion punched from said elongated planar brace member and bent substantially perpendicular to said lower planar surface to form a fifth tab spaced from said fourth tab, said fifth tab having a fifth flared lower portion;

a sixth portion punched from said elongated planar brace member and bent substantially perpendicular to said lower planar surface to form a sixth tab spaced from said fifth tab to define a third planar portion of said elongated brace member therebetween, said sixth tab having a sixth flared lower portion;

a first reinforcing rib segment integrally formed in a portion of said elongated planar brace member extending between said second tab and said third tab;

a second reinforcing rib segment integrally formed in a portion of said elongated planar brace member extending between said fourth and fifth tab;

at least one first fastener opening extending through at least one of said first planar portion and said first and second tabs;

at least one second fastener opening extending through at least one of said second planar portion and said second and third tabs; and at least one-third fastener opening extending through at one of said third planar portion and said fifth and sixth tabs.

54. A spacer bar, comprising:

an elongated planar brace member having a planar upper surface and a planar lower surface;

a first end portion of said elongated planar brace member bent substantially perpendicular to said lower planar surface to form a first tab;

a second portion punched from said elongated planar brace member and bent substantially perpendicular to said lower planar surface to form a second tab spaced from said first tab such that a first planar portion of said planar brace member extends therebetween;

a third portion punched from said elongated planar brace member and bent substantially perpendicular to said lower planar surface to form a third tab spaced from said second tab; and a second end portion of said elongated planar brace member bent substantially perpendicular to said lower planar surface to form a fourth tab spaced from said third tab to define a second planar portion of said elongated brace member therebetween and wherein at least one of said first tab and said second tab have a flared lower portion and wherein at least one of said third and fourth tabs have a lower flared portion.

55. The spacer bar of claim 54 further comprising a first reinforcing member centrally disposed in a portion of said elongated planar brace member extending between said second tab and said third tab.

56. The spacer bar of claim 55 wherein said reinforcing member comprises a first reinforcing rib segment integrally formed in said portion of said elongated planar brace member extending between said second tab and said third tab.

57. The spacer bar of claim 54 further comprising at least one fastener opening in said first planar portion of said elongated brace member and at least one fastener opening in said second planar portion.

* * * * *

UNITED STATES PATENT AND TRADEMARK OFFICE

CERTIFICATE OF CORRECTION

PATENT NO. : 6,418,695 B1
DATED : July 16, 2002
INVENTOR(S) : Daudet et al.

It is certified that error appears in the above-identified patent and that said Letters Patent is hereby corrected as shown below:

Column 17,
Line 23, delete “450” and replace therewith -- 45° --.

Column 18,
Lines 43 and 45, delete “greater than” and replace therewith -- substantially equal to --.

Signed and Sealed this

Twenty-fifth Day of March, 2003

JAMES E. ROGAN
*Director of the United States Patent and Trademark Office*